US005799232A

United States Patent [19]

Tompkins et al.

[11] Patent Number: 5,799,232

[45] Date of Patent: Aug. 25, 1998

[54] FRICTION DRIVE FOR AN ELECTROPHOTOGRAPHIC PRINT ENGINE

[75] Inventors: E. Neal Tompkins, Atlanta; Keith J. Bradley, Dunwoody; Peter A. Zuber, Norcross, all of Ga.

[73] Assignee: T/R Systems, Norcross, Ga.

[21] Appl. No.: 727,791

[22] Filed: Oct. 7, 1996

[51] Int. Cl.[6] ..... G03G 15/00; G03G 15/16

[52] U.S. Cl. ..... 399/167; 399/308

[58] Field of Search ..... 399/303, 318, 399/167, 159, 302, 308

[56] References Cited

U.S. PATENT DOCUMENTS

| | | | |
|---|---|---|---|
| 4,862,214 | 8/1989 | Kasahara et al. | 399/303 |
| 5,070,366 | 12/1991 | Tsuchiya | 399/167 |
| 5,126,800 | 6/1992 | Shishido et al. | 399/167 X |
| 5,202,733 | 4/1993 | Hediger et al. | 399/303 |
| 5,432,590 | 7/1995 | Nomura et al. | 399/167 |
| 5,666,596 | 9/1997 | Yoo | 399/159 X |

*Primary Examiner*—S. Lee

*Attorney, Agent, or Firm*—Gregory M. Howison; Mark W. Handley

[57] ABSTRACT

A print engine is provided for electrophotographically transferring an image from an image source to an image-support member. The print engine includes a photoconductive member having a photoconductive surface for storing a latent, electrostatic image. A photoconductive drum charger and an image transfer device generate the latent, electrostatic image on the photoconductive surface. A developer station supplies developer to the latent, electrostatic image as it is being carried by the photoconductive surface to provide a developed image. A carrier member includes an electrically charged support surface for supporting an image-support member which is passed through an image transfer nip. The image transfer nip extends between the photoconductive member and the carrier member. The image-support member and the developed image are simultaneously passed through the image transfer nip so that the developed image is transferred to the image-support member. A mounting assembly is provided for movably supporting the photoconductive member and the carrier member in a relative frictional engagement therebetween, wherein the carrier member is pressed into the photoconductive member so that the support surface of the carrier member will move at substantially the same speed through the image transfer nip as the photoconductive surface of the photoconductive member in response to movement of the photoconductive member.

31 Claims, 11 Drawing Sheets

FRICTION DRIVE FOR AN ELECTROPHOTOGRAPHIC PRINT ENGINE

TECHNICAL FIELD OF THE INVENTION

The present invention relates in general to print engines, and in particular, to a power drive system for a print engine.

BACKGROUND OF THE INVENTION

Prior art print engines have been used in both copiers and printers for electrophotographic printing. Prior art print engines have included photoconductive transfer members and paper carrier members. Either or both of these members may be a cylindrical drum or a belt. The belts typically extend over cylindrical rollers. The photoconductive transfer member generally travels beneath a photoconductive drum charger and then an image generator which together place a latent image of electrostatic charge upon an exterior surface of the photoconductive transfer member. The surface of the photoconductive transfer member then moves the latent image of electrostatic charge beneath a developer station. Toner is applied to the latent image to provide a developed image. The toner may be black or one of multiple colors, depending upon whether a color image or a black and white image is being produced.

After passing through the developing station, the developed image is transferred to an image-support member, which is typically a sheet of paper, but may also be a sheet of clear plastic such as the type used for overhead projector transparencies. The image-support member is secured to and carried on the carrier member, which transports the image-support member through an image transfer nip. The image-support member and the developed image are simultaneously transported through the image transfer nip by the carrier member and the photoconductive transfer member, respectively. The image-support member and the surface of the photoconductive transfer member are usually supported at the image transfer nip by counter rotating cylinders which are rotating at precisely controlled angular velocities such that the developed image and the image-support member will pass through the image transfer nip at precisely the same speed and in proper alignment. In some cases, a double transfer drum or belt is used in which the carrier member includes an image-support member which is permanently mounted to and part of the carrier member. The image is typically transferred to a second image-support member, such as a sheet of paper.

The alignment between the latent image and the image-support member at the image transfer nip is herein defined by the term "registration." Proper registration between the developed image and the image-support member becomes even more critical when color images are being produced. Typically, for color printing, each of three colors are sequentially transferred from the photoconductive transfer member to the image-support member as partial images. For each of the three colors, a partial latent image of electrostatic charge is first placed on the surface of the photoconductive transfer member, developed with a toner of the corresponding color and then passed through the image transfer nip with the counter rotating image-support member such that the developed partial image will be transferred to the image-support member. Additionally, a fourth developed partial image may be passed from the photoconductive transfer member to the image-support member for black and white portions of a composite image being transferred to the image-support member. Thus, the image-support member may be passed through the image transfer nip four separate times for transfer of the complete, composite color image. Each of the partial images must properly register with the other partial images for the composite image to be correctly produced.

Proper registration between the various developed partial images and the image-support member has been accomplished by using direct gear drives and meshing gears to directly couple together the photoconductive transfer member and the carrier member. Spur gears are typically used. Often, the photoconductive transfer member and the carrier member are firmly mounted to cylinders to provide cylindrical drums. The cylindrical drums are aligned with central longitudinal axes of the drums being parallel and spaced apart, such that the image-support member will be pressed into the surface of the photoconductive transfer member at the image transfer nip. Gears are coaxially mounted to each of the cylindrical drums and mesh with one another such that, when one of the cylindrical drums turns, the other drum will also turn. Typically, the cylindrical drum on which the photoconductive transfer member is mounted will be directly driven by a drive motor, and the other cylindrical drum, on which the carrier member is mounted, will be directly driven by the gears. The cylindrical drum for the carrier member is usually pressed toward the cylindrical drum for the photoconductive transfer member with sufficient force to cause the gears to mesh.

Several problems have arisen with these types of prior art print engines. Often, when the cylindrical drum for the carrier member is pressed toward the cylindrical drum for the photoconductive transfer member with sufficient force for the gears to properly mesh, the carrier member will press the image-support member into the surface of the photoconductive member with excessive force, causing a condition known as fine-line breakup. Excessive pressure at the image transfer nip causes the lines of an image to widen, and often a blank space may appear in the center of the lines. Additionally, mechanical gears have a condition known as "gear lash" caused by the clearances between the teeth of the intermeshing gears. Gear lash causes a banding pattern in which sections of the images are compressed and decompressed on the carrier member in a direction in which the carrier member is fed through the image transfer nip. Image banding patterns generally increase when the cylindrical drums are pushed together with insufficient force for the gears to properly mesh. Increasing the differential electrical potential between the photoconductive transfer member and the carrier member is of little effect in correcting fine-line breakup and image banding patterns.

SUMMARY OF THE INVENTION

The present invention disclosed and claimed herein comprises a print engine for electrophotographically transferring an image from an image source to an image-support member. The print engine includes a photoconductive transfer member having a photoconductive surface for storing a latent, electrostatic image. The latent, electrostatic image is first formed on the photoconductive surface of the photoconductive transfer member. A developer station supplies developer to the latent, electrostatic image as it is being carried by the photoconductive surface of the transfer member to provide a developed image. A carrier member includes an electrically charged support surface for supporting an image-support member, which is passed through an image transfer nip. The image transfer nip extends between the photoconductive transfer member and the carrier member. The image-support member and the developed image are simultaneously passed through the image transfer nip such that the developed image is transferred to the image-support member. A mounting assembly is provided for movably supporting the photoconductive transfer member and the carrier member with a relative frictional engagement therebetween, wherein the carrier member is pressed into the photoconductive transfer member so that the support surface of the carrier member will move at substantially the same speed through the image transfer nip as the photoconductive surface of the photoconductive transfer member in response to movement of the photoconductive transfer member.

It is another aspect of the present invention that the surfaces of the photoconductive transfer member and the carrier member each have clean, dry regions which are disposed outside of an image path for engaging one another in the frictional engagement.

It is another aspect of the present invention that the carrier member includes two bands of material having a high coefficient of friction which are disposed on opposite sides of the carrier member from one another, outward of the image path.

It is another aspect of the present invention that the photoconductive transfer member and the carrier member are each cylindrical drums, the photoconductive transfer member having a photoconductive layer which defines a circumferentially extending periphery thereof, and the carrier member having a resilient layer which defines an exterior circumferentially extending periphery of the carrier member.

BRIEF DESCRIPTION OF THE DRAWINGS

For a more complete understanding of the present invention and the advantages thereof, reference is now made to the following description taken in conjunction with the accompanying Drawings in which:

FIGS. 18 and 19 show varying values for the effective modulus of elasticity;

DETAILED DESCRIPTION OF THE INVENTION

Figure 1:
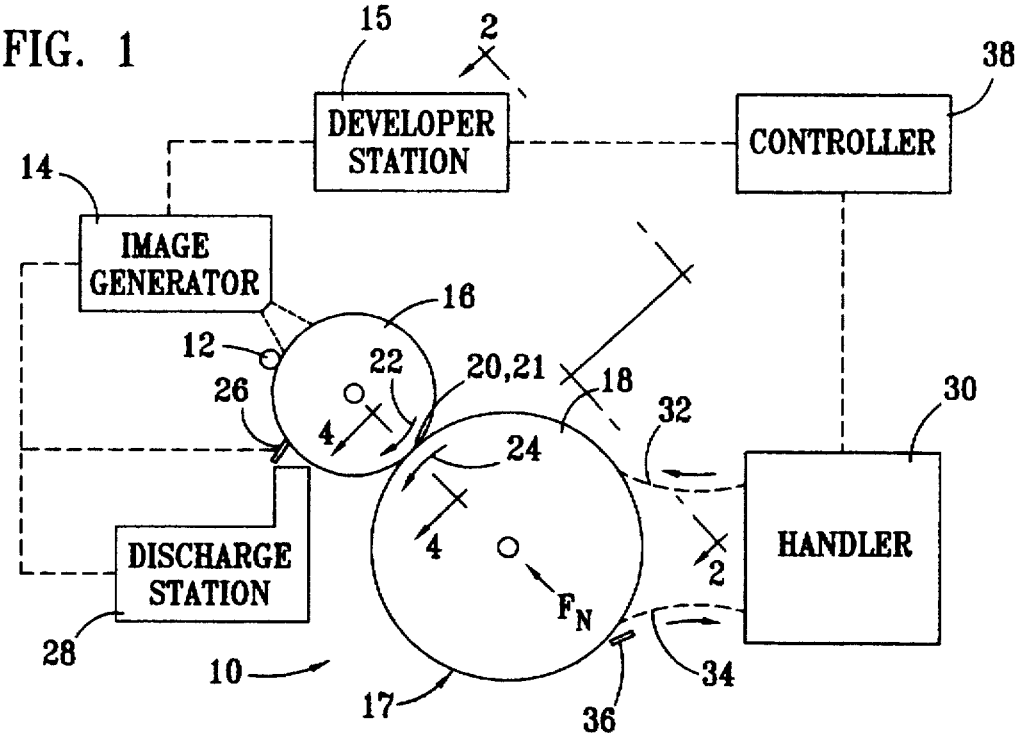
FIG. 1 illustrates a schematic diagram of a print engine made according to the present invention.

Referring now to FIG. 1, there is illustrated a schematic diagram of a print engine 10 of the preferred embodiment of the present invention. The print engine 10 includes a photoconductive drum charger 12 and an image generator 14, which together provide an image transfer device of the type used in either a printer or a photocopier. The print engine 10 further includes a developer station 15. The developer station 15 contains toner and is preferably of the type for developing color images. A cylindrical photoconductive drum 16 provides a photoconductive transfer member having a photoconductive surface.

The photoconductive drum 16 rotates beneath the photoconductive drum charger 12, the image generator 14 and the developer station 15. The photoconductive drum charger 12 deposits a substantially uniform blanket of electrostatic charge on the surface of the photoconductive drum 16. The image generator 14 then generates light of various intensities to discharge selected regions of the blanket of electrostatic charge, which provides a latent, electrostatic image on the surface of the photoconductive drum 16. The print engine 10 further includes a carrier member 17, which preferably includes a cylindrical drum 18. The carrier drum 18 has a cylindrical exterior support surface. The carrier drum 18 engages the photoconductive drum 16 at an image transfer nip 20 and at two (2) spaced apart frictional engagement nips 21. The photoconductive drum 16 and the carrier drum 18 are counter rotating members, with photoconductive transfer drum 16 rotating in an angular direction 22 and carrier member drum 18 rotating in an angular direction 24.

A cleaning station 26 and a discharge station 28 are disposed aside of photoconductive drum 16, after the image transfer nip 20, for removing remaining toner and electrostatic charge from the photoconductive surface of drum 16. An image-support member handler 30 is provided for feeding image-support members, which are typically sheets of paper, along a path 32 to the carrier drum 18 and then for receiving the image-support members from carrier drum 18 along path 34. A diverter 36 is provided for selectively operating to remove the image-support members from the carrier drum 18 and directing them into the path 34. The print engine 10 further includes a programmable controller 38, which controls the operation of print engine 10. The programmable controller 38 preferably includes a central processing unit, memory storage and input-output channels.

Figure 2:
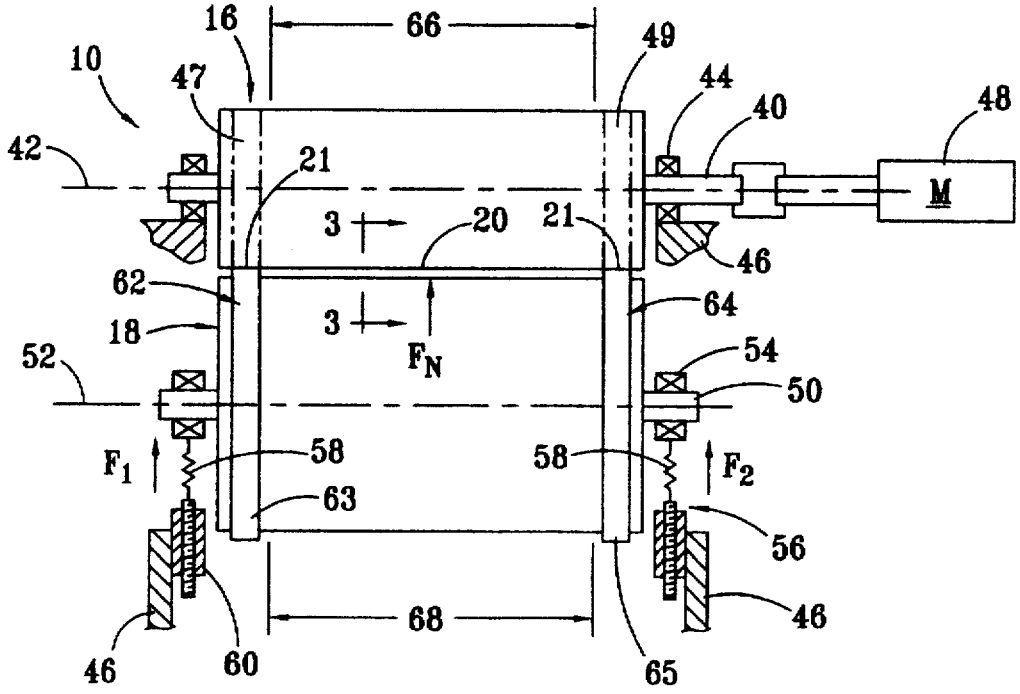
FIG. 2 illustrates a partial side view of a portion of the print engine of FIG. 1, viewed along section line 2—2 of FIG. 1.

Referring now to FIG. 2, there is illustrated a partial side view of the print engine 10, as would be viewed along section line 2—2 of FIG. 1. The photoconductive drum 16 is mounted to a shaft 40 for rotating around a longitudinal axis 42. The cylindrical surface of the exterior of the photoconductive drum 16 is concentrically disposed around the longitudinal axis 42. The shaft 40 is mounted by bearings 44 to a frame 46. A drive motor 48 is mechanically coupled to the shaft 40 to provide a direct mechanical drive for powering rotation of the shaft 40. The photoconductive transfer member 16 is rigidly mounted to and rotates with shaft 40. Of course, a gear coupling could also be utilized to mechanically couple the shaft 40 to the drive motor 48 for directly driving the shaft 40 with drive motor 48. If the rigid coupling of FIG. 2 is used, rather than a gear coupling, gear backlash is avoided. Two frictional engagement regions 47 and 49 (shown in phantom) are provided by outwardly disposed, cylindrical regions of photoconductive transfer member 16, which are flush with and part of the photoconductive surface thereof The two friction regions 47 and 49 are preferably the opposite side of the photoconductive surface of drum 16, and provide friction drive surfaces.

The carrier drum 18 is concentrically mounted to a shaft 50 for rotating around a longitudinal axis 52. The cylindrical exterior support surface of carrier drum 18 extends concentrically around the longitudinal axis 52. The longitudinal axis 52 of carrier drum 18 is parallel to the longitudinal axis 42 of the photoconductive drum 16. The bearings 54 rotatably secure the shaft 50 to a mounting assembly 56. The bearings 54 are secured to the frame 46 by the mounting assembly 56. The mounting assembly 56 preferably includes two springs 58 and two control members 60. The springs 58 secure the bearings 54 to the control members 60. The control members 60 moveably interface the springs 58 to the frame 46. The control members 60 are selectively operable for retracting and extending in parallel directions to move the position of the shaft 50 of the carrier drum 18 with respect to the frame 46, which controls the force with which the carrier drum 18 is pressed into the photoconductive image transfer member 16. The carrier drum 18 is pressed into the image transfer member 16 with forces F1 and F2. In the preferred embodiment of the present invention, the control members 60 are provided by a manual type of adjustment means for varying the forces F1 and F2, which the springs 58 apply to the bearings 54, urging the shaft 50 toward the shaft 40, and the carrier drum 18 against the photoconductive drum 16.

Two cylindrical bands 62 and 64 are provided by two strips of friction tape which are mounted to the cylindrical surface of and circumferentially extend around opposite ends of the carrier drum 18 to provide regions of high coefficients of friction. The two friction bands 62 and 64 are spaced apart so that they define two spaced apart frictional engagement surfaces 63 and 65, respectively, which are preferably surfaces having higher coefficients of friction than the adjacent exterior support surface of the carrier drum 18. The friction bands 62 and 64 provide two spaced apart circumferentially extending ribs on opposite sides of the image path 68, raised above, or offset from, a support surface 75. The bands 62 and 64 engage photoconductive transfer drum 16 on opposite sides and outside of an image path 66. Preferably, the friction bands 62 and 64 are provided by a composite material, such as a fiberglass tape, which is relatively incompressible as compared to the support surface 75 of the resilient layer 76 (shown in FIG. 3) of carrier drum 18.

Figure 3:
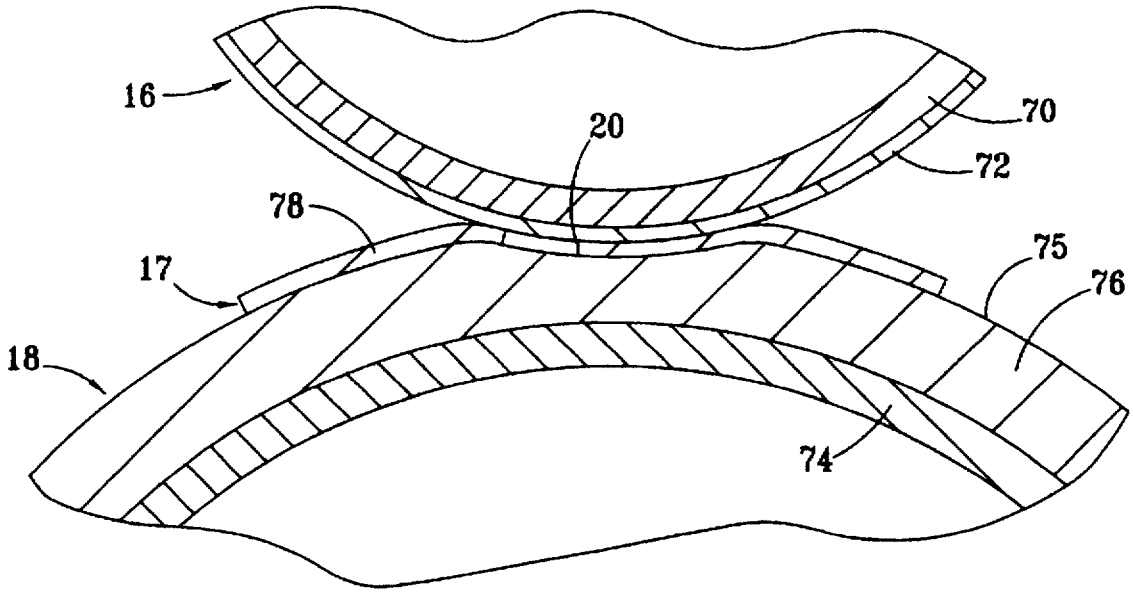
FIG. 3 illustrates a partial section view of the print engine of FIG. 2, taken along section line 3—3 of FIG. 2.

Referring now to FIG. 3, there is illustrated a sectional view of the photoconductive transfer drum 16 and the carrier drum 18, taken along section line 3—3 of FIG. 2. The photoconductive transfer member 16 is preferably a cylindrical drum, having a hollow, aluminum, cylindrical core 70, which is preferably 0.6 inches thick. Photoconductive transfer drum 16 includes an outer periphery which defines a photoconductive surface 72. Photoconductive surface 72 is provided by an organic photoconductor which is twenty micrometers thick and extends around the outer cylindrical surface of cylindrical core 70. The outside diameter of the photoconductive surface 72 of the photoconductive transfer member drum 16 preferably measures 2.756 inches.

The carrier member 17 preferably includes the cylindrical drum 18 having a hollow, conductive, cylindrical core 74 with a wall thickness of 0.25 inches, measured in a radially extending direction. Conductive core 74 may be formed of a metal, such as aluminum, or another type of material, such as a conductive plastic. Cylindrical drum 18 further includes the resilient layer 76 which extends around the cylindrical core 74 and which is preferably provided by butadine acrylonitrile, having a hardness of 25 shore A durometer and a thickness of 0.125 inch. The overall outside diameter of the exterior surface 75 of the resilient layer 76 of the carrier drum 18 is preferably 5.512 inches. It should also be noted that the materials and the hardnesses of the materials for the cylindrical core 74 and the resilient layer 76 may vary according in various embodiments of the present invention. The carrier member 18 also includes an image-supporting member 78, which is depicted in FIG. 3 as a sheet of paper which is passing through the image transfer nip 20. A periphery of cylindrical drum 18 includes the frictional surfaces 63 and 65 of the friction bands 62 and 64, and the exterior surface 75 of the resilient layer 76.

Figure 4:
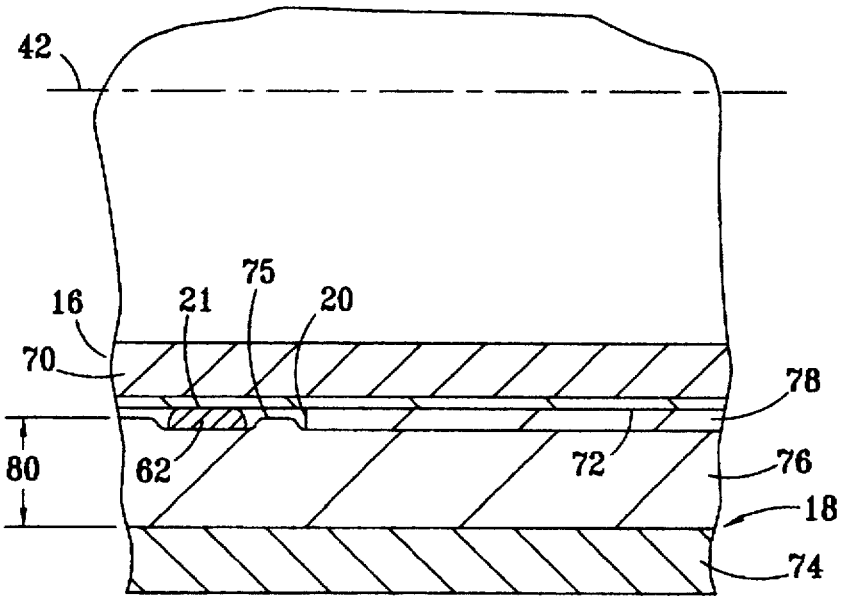
FIG. 4 illustrates a partial section view of the print engine of FIG. 1, taken along section line 4—4 of FIG. 1.

Referring now to FIG. 4, there is illustrated a partial sectional view of the photoconductive transfer member drum 16 and the carrier drum 18, taken along section line 4—4 of FIG. 1. It depicts the image-support member 78 being carried through the image transfer nip 20 by the carrier drum 18. The friction band 62 is also depicted. The friction band 62 is being squeezed between the photoconductive transfer drum 16 and the carrier drum 18, such that it is compressed in the radial direction between the drums 16 and 18, and expanded outward in a lateral direction between the drums 16 and 18. The total normal force $F_N$ applied to press carrier drum 18 into transfer drum 16 applies a normal pressure to compress the image-support member 78, the friction band 62 and the friction band 64 (shown in FIG. 2) between the photoconductive image transfer drum 16 and the carrier drum 18. A normal pressure is herein defined to be the force resulting from the normal force $F_N$ acting to press drums 16 and 18 together.

Applying the combined normal force $F_N$ to press the carrier drum 18 into the photoconductive drum 16 results in a deflection which is herein defined to be a change in a distance 80 across the resilient layer 76 and the friction bands 62 and 64 in a radial direction. The distance 80 is used herein as the initial, undeflected distance of the region of the print engine 10, which is deflected when acted upon by the compression normal force $F_N$. Substantially all of the deflection from compression caused by the force $F_N$ acting across the distance 80 occurs across the friction bands 62 and 64, and the portion of the resilient layer 76 which extends underneath the friction bands 62 and 64, that is, the portion of the resilient layer 76 which is disposed at the frictional engagement nips 21. The portion of the resilient layer 76 which is disposed between the friction bands 62 and 64, that is, the portion of the resilient layer 76 which is disposed at the image transfer nip 20, will preferably not be deflected until an image-supporting member 78 is disposed within the image transfer nip 20. The distance 80 extends perpendicular to the longitudinal axes 42 and 56.

The print engine 10 should be constructed and operated such that the frictional engagement between the photoconductive transfer drum 16 and carrier drum 18 provides an acceptable drive coupling. A frictional engagement of an acceptable drive coupling is herein defined as that which is provided by a normal force $F_N$ which is sufficient to assure that acceptable tracking will result between the two drums 16 and 18. A sufficient normal force $F_N$ for acceptable tracking is herein defined as a force of a minimum value which presses the photoconductive drum 16 and the carrier drum 18 together such that there is substantially no misregistration in four sequential image transfers. Thus, when the sufficient normal force $F_N$ is applied to press photoconductive drum 16 and the carrier drum 18 together, the frictional engagement of the acceptable drive coupling will be provided such that there be no appreciable slippage between the carrier drum 18 and the photoconductive drum 16 at the image transfer nip 20.

As used herein, a normal force $F_N$ refers to the vector component of the total of forces $F_1+F_2$, which press the photoconductive drum 16 and carrier drum 18 together. The normal force $F_N$ is the vector component of the total of forces $F_1+F_2$, which extends perpendicular to the engaged portions of the surface of the photoconductive drum 16 and carrier drum 18 at the frictional engagement nip 21. In general, for the print engine 10 having two counter rotating, cylindrical drums 16 and 18 which define the image transfer and frictional engagement nips 20 and 21, the normal force $F_N$ will extend through of the longitudinal axes 42 and 56 of the cylindrical drums 16 and 18, respectively. In the preferred embodiment, the normal force $F_N$ component of the total of forces $F_1+F_2$, which press the photoconductive drum 16 into the carrier drum 18, extends through the axes 42 and 52, perpendicular to axes 42 and 52.

In the preferred embodiment, during operation of the friction drive print engine 10, the normal force $F_N$ is applied to the carrier drum 18, pushing it towards the photoconductive drum 16, such that the fraction bands 62 and 64 will press into the cylindrical photoconductive the surface 72 of the photoconductive drum 16. As the normal force $F_N$ increases to a sufficient level, an acceptable drive coupling is achieved between the photoconductive drum 16 and the carrier drum 18. When the sufficient level of force is present, the drive coupling is such that acceptable registration, that is tracking, is maintained between both drums 16 and 18.

As the normal force $F_N$ continues to increase, the image-support member 78 on the outer surface of the resilient layer 76 of the carrier drum 18 contacts the surface 72 of the photoconductive drum 16, and pressure builds in the image transfer nip 20 where the photoconductive transfer member extends in contact with both the carrier member 18 and the photoconductive drum 16. Preferably, the cylindrical surface 72 of the photoconductive transfer member 16 will not touch the cylindrical surface of the resilient layer 76 at the image paths 66 and 68 such that pressure will only be present in the image transfer nip 20 when the image-support member 78 is disposed therein. However, when an image-support member 78 is in the image transfer nip 120, given some range of values for the modulus of elasticity and the thickness of the combination of materials being compressed in the image transfer nip 20, the pressure in the image transfer nip 20 for a particular range of normal forces $F_N$ could stay below, reach or exceed the pressure limit for fine line breakup.

Given some set of parameters for the thickness and width of the friction bands 62 and 64, the modulus of elasticity and thickness of the materials of the image transfer nip 20, then an acceptable drive coupling can be provided between the carrier member 18 and the photoconductive drum 16. Once these parameters are known, the minimum normal force $F_N$ sufficient for providing an acceptable drive coupling can be empirically determined. The following sets forth a predictive model that determines the range of normal forces $F_N$ required for both providing an acceptable drive coupling and for avoiding fine line breakup. From such a predictive model, an upper and lower range of the modulus of elasticity and the thickness of the materials of the image transfer nip 20, and the widths and thicknesses of friction bands 62 and 64 can be defined for various drum-to-drum contact architectures using the minimum and maximum values for the normal force $F_N$.

As the carrier drum 18 and photoconductive drum 16 are pressed together with a normal force $F_N$ of increasing value, the central axes 42 and 52 of the carrier drum 18 and the photoconductive drum 16, respectively, will be pressed closer together. This change in distance between the central axes 42 and 52 of the photoconductive drum 16 and the carrier drum 18, respectively, will cause the deflection of the distance 80 of the friction bands 62 and 64, and the portion of the resilient layer 76 disposed underneath the friction bands 62 and 64. An effective, composite modulus of elasticity for the carrier drum 18 and the photoconductive drum 16 configuration can be determined according to the equation for Young's modulus of elasticity, which defines the pressure on a compressed surface as:

$$M = \frac{\frac{F_N}{A}}{\frac{\Delta l}{lo}} \quad (1)$$

where:

$F_N$=normal force applied

A=area being compressed

Δl=compression deflection lo=uncompressed thickness across distance 80

For the image transfer nip 20 and the frictional engagement nip 21,"A" and "Δl" will increase as the normal force $F_N$ being applied to each of the nips 20 and 21 increases, with the values of the increases depending upon the effective composite modulus of elasticity of the composite of materials involved in compression between the photoconductive drum 16 and the carrier drum 18.

Figure 5:
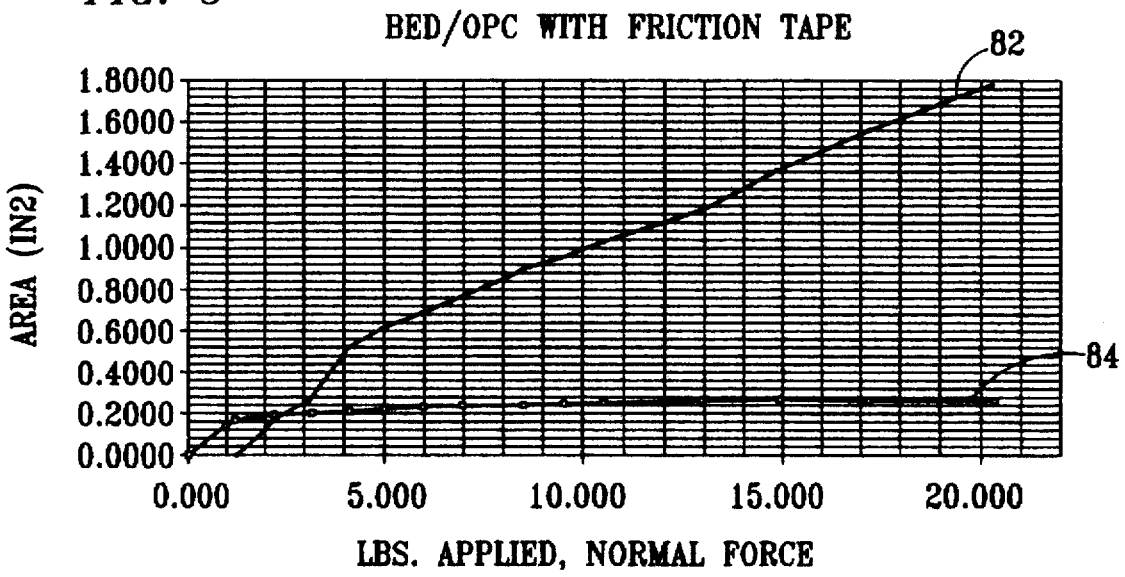
FIG. 5 illustrates a graph of the surface area of the image transfer nip and the surface area of the frictional engagement nip versus corresponding values of the normal force applied to press the carrier member into the photoconductive transfer member.

Referring now to FIG. 5, there is illustrated a graph having two curves which depict the surface area of the image transfer nip 20 and the surface area of the frictional engagement nip 21 versus the total normal force $F_N$ applied to press the carrier drum 18 and the photoconductive drum 16 together. A curve 82 represents the graph of the surface area of the image transfer nip 20 versus the total normal force $F_N$ applied to press the carrier drum 18 and the photoconductive drum 16 together with the image-support member 78 disposed within the image transfer nip 21. A curve 84 represents a graph of the surface area of the frictional engagement nip 21 versus the total normal force $F_N$ applied to press the carrier drum 18 and the photoconductive drum 16 together with the image-support member 78 disposed within the image transfer nip 21.

Figure 6:
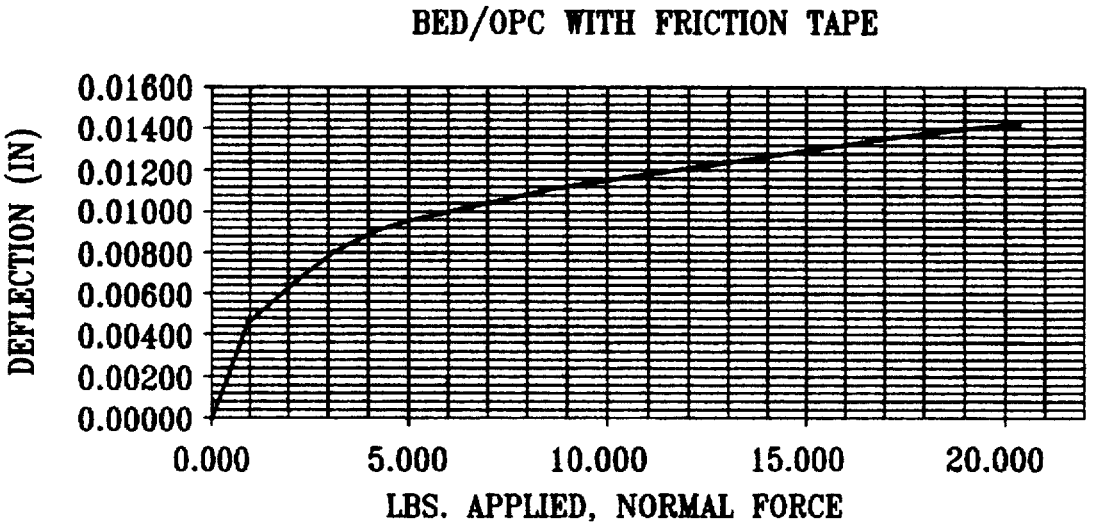
FIG. 6 illustrates a graph of the total deflection between a photoconductive transfer member and a carrier member of the preferred print engine versus the normal force applied to push the carrier member into the photoconductive member.

Referring now to FIG. 6, there is illustrated a graph of the deflection of the distance 80 between the photoconductive drum 16 and the carrier drum 18 of the print engine 10 versus the normal force $F_N$ applied to push the carrier drum 18 into the photoconductive drum 16.

Figure 7:
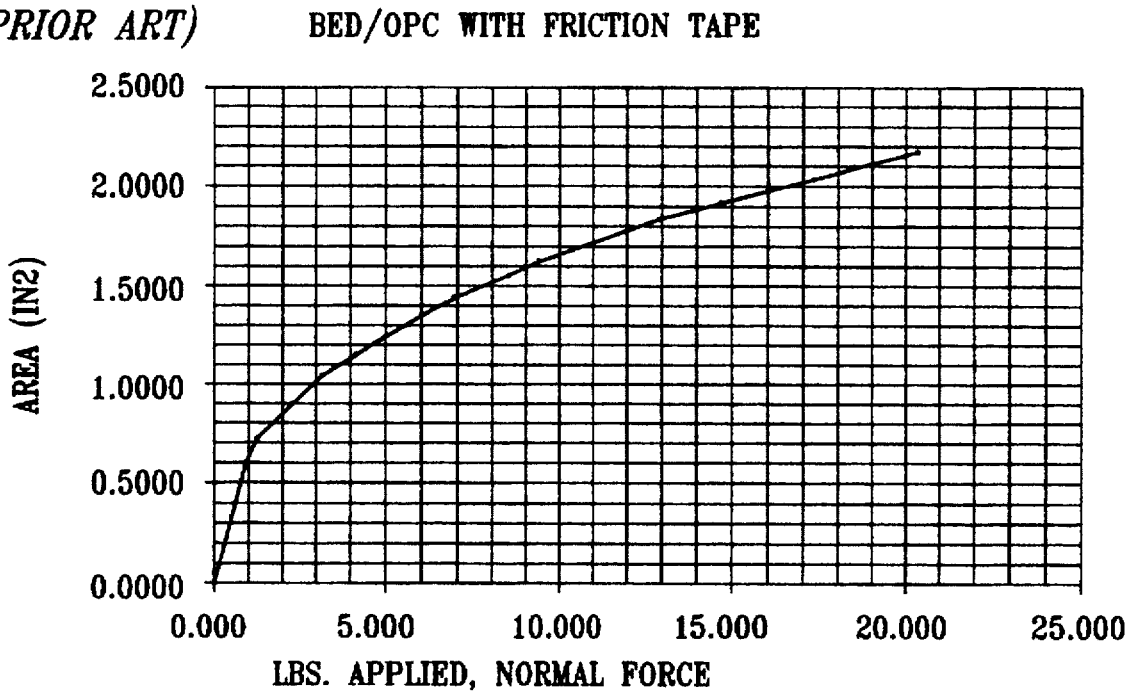
FIG. 7 (PRIOR ART)
FIG. 7 illustrates a graph of the squeezed area of the image transfer nip of the photoconductive transfer member and the carrier member of a prior art print engine versus the normal force applied for such deflections.

The graphs of FIGS. 5 and 6 were empirically determined by deflecting the carrier drum 18 into the photoconductive drum 16 using a series of known forces, and then measuring the resulting deflections and surface areas created by the interferences between the carrier drum 18, the photoconductive drum 16 and the image-support member 78 in the image transfer nip 20, and between the carrier drum 18, the photoconductive drum 16, and the friction bands 62 and 64 of the frictional engagement nip 21. Next, the portion of the normal force $F_N$ which contributes to the deflection and area of the image transfer nip 20 was determined by deflecting a prior art carrier drum into a prior art photoconductive drum of a prior art print engine with several known values for the normal force $F_N$, and measurement of the resultant areas and deflections of the transfer nip, as depicted in FIG. 7, which is discussed below. Then, the measured resultant areas and deflections were correlated to the image transfer nip 20 areas and deflections for the present invention to determine the portion of the total normal force $F_N$ which is being applied to the image transfer nip 20. Then, the portion of the total normal force $F_N$ which was being applied at the frictional engagement nip 21 was equal to the total normal force $F_N$ minus the portion of the total normal force $F_N$ applied at the image transfer nip 20.

Referring now to FIG. 7, there is illustrated a graph of the compressed area of the image transfer nip between the photoconductive drum and the carrier drum of a prior art print engine versus the normal force $F_N$ applied for the deflections. The areas of FIG. 7 can be correlated to the numerically equivalent areas of FIGS. 5 and 6 to determine the amount of that portion of the total normal force $F_N$ of FIGS. 5 and 6 which is applied across the image transfer nip 20. The value for the portion the normal force $F_N$ applied across the image transfer nip 20, for a particular resultant area, is the normal force give in FIG. 7. The remainder of the total normal force $F_N$ contributes to the frictional engagement applied across the friction bands 62 and 64 at friction nip 21, to deflect the friction bands 62 and 64. These values are shown in tabular form in Table I.

TABLE I

| Total Normal force $F_N$ (lbs) | Friction Band Nip Normal force (lbs) | Image Transfer Nip Normal force (lbs) |
|---|---|---|
| 0.000 | 0.000 | 0.000 |
| 0.903 | 0.903 | 0.000 |
| 1.255 | 1.255 | 0.000 |
| 2.255 | 1.995 | 0.260 |
| 3.155 | 2.745 | 0.410 |
| 4.155 | 3.355 | 0.800 |
| 5.055 | 4.055 | 1.000 |
| 6.055 | 4.865 | 1.190 |
| 6.955 | 5.485 | 1.470 |
| 8.485 | 6.185 | 2.300 |
| 9.485 | 6.835 | 2.650 |
| 10.385 | 7.285 | 3.000 |
| 12.935 | 8.445 | 4.490 |
| 14.835 | 8.780 | 6.055 |
| 17.299 | 8.814 | 8.485 |
| 20.277 | 8.227 | 12.050 |

Knowing the area, deflection and the portion of the normal force $F_N$ applied to the image of transfer nip 20, the modulus of elasticity and pressure in the image transfer nip 20 is determined. These values are shown in Table II.

TABLE II

| Image Transfer Nip Normal Force (lbs) | Image Transfer Nip deflection | Image Transfer Nip area | Image Transfer Pressure | Image Transfer Nip Modulus |
|---|---|---|---|---|
| | | | | 349.61 |
| 0 | 0 | 0 | 0 | 0 |
| 0.8 | 0.00045 | 0.521 | 1.534 | 450.07 |
| 1 | 0.00057 | 0.629 | 1.590 | 368.17 |
| 1.19 | 0.00067 | 0.700 | 1.700 | 334.93 |
| 1.47 | 0.00082 | 0.765 | 1.922 | 309.33 |
| 2.3 | 0.00118 | 0.901 | 2.553 | 285.56 |
| 2.65 | 0.00133 | 0.955 | 2.775 | 275.40 |
| 3.1 | 0.00151 | 1.025 | 3.024 | 264.38 |

Figure 8:
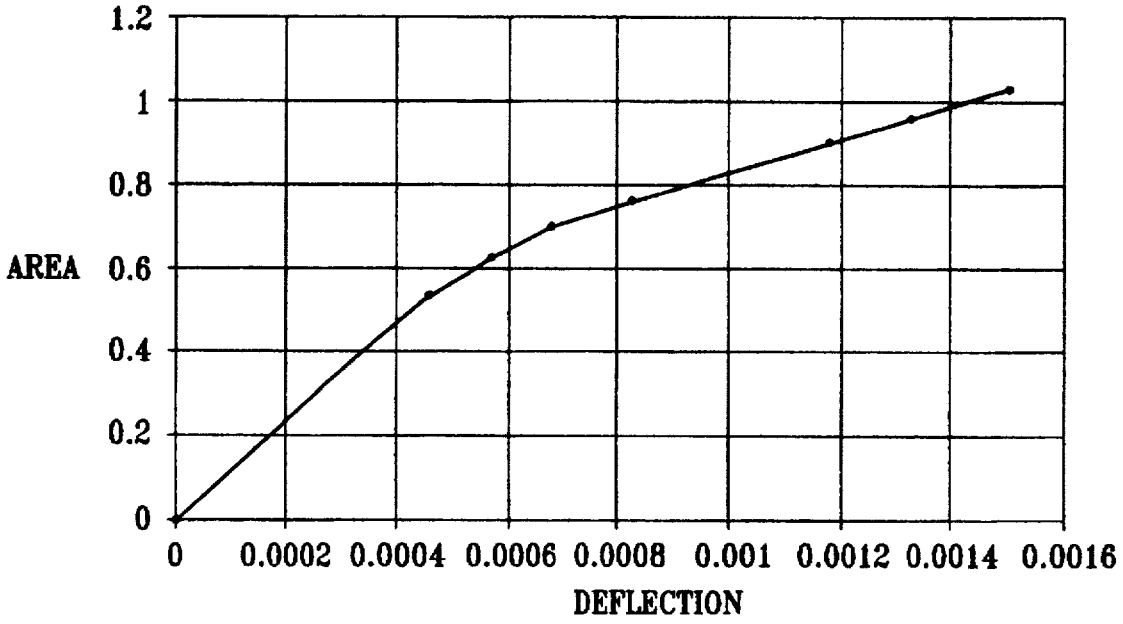
FIG. 8 illustrates a graph of the squeezed surface area of the image transfer nip versus the deflection between the photoconductive transfer member and carrier member for the preferred print engine of the present invention.
Figure 9:
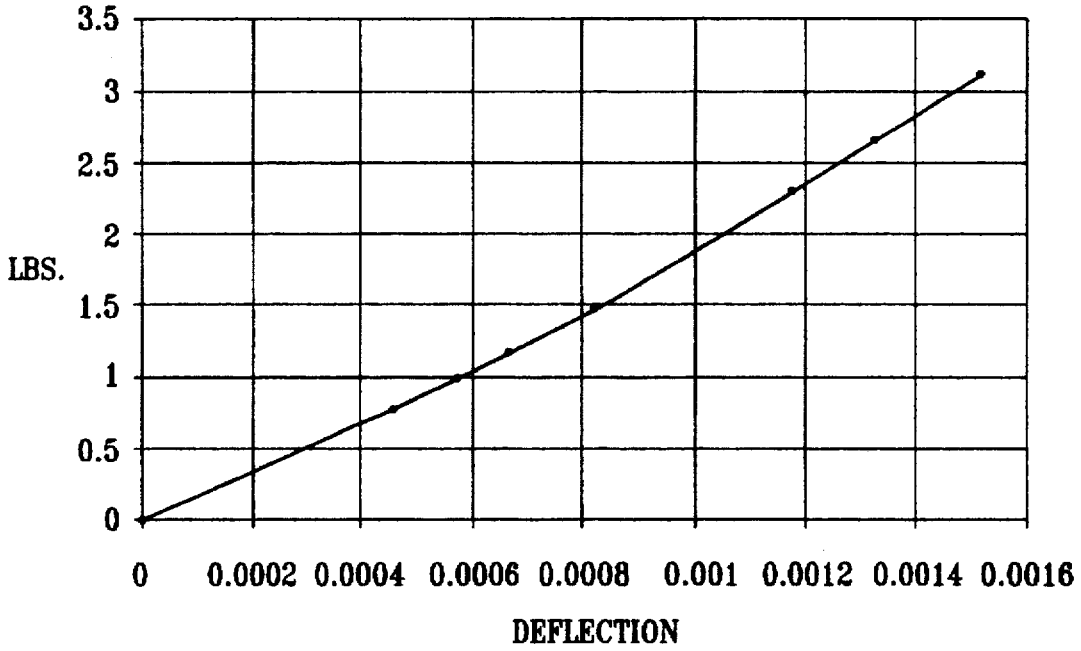
FIG. 9 illustrates a graph of the portion of the normal force applied across the image transfer nip to press the photoconductive transfer member and the carrier member together versus the deflection between the photoconductive member and the image-support member for the preferred print engine of the present invention.
Figure 10:
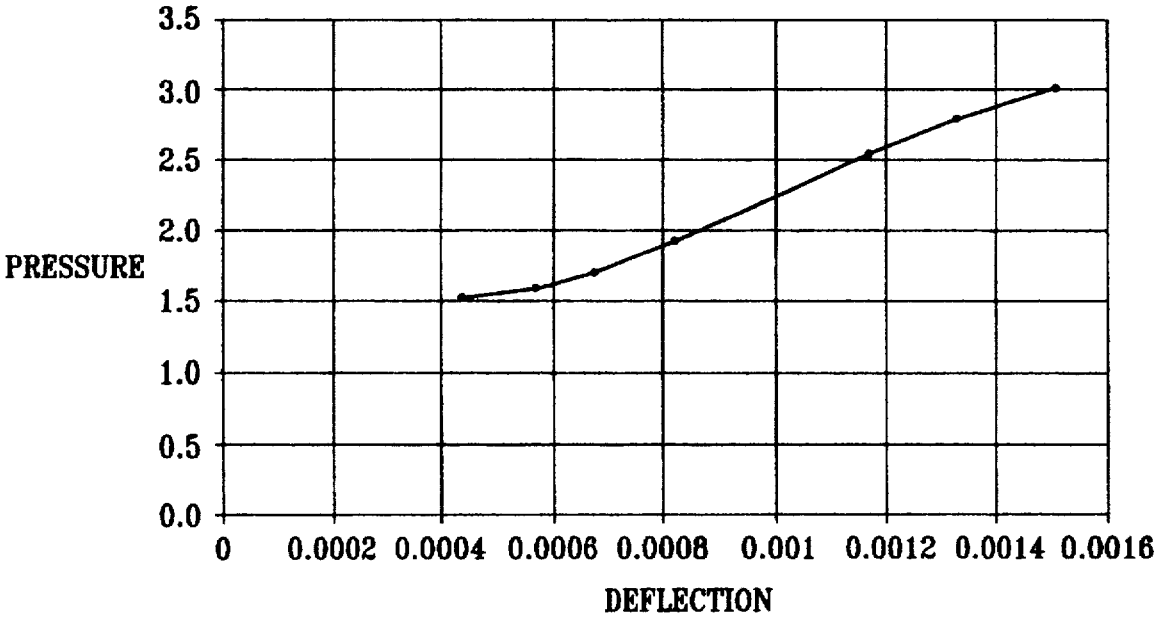
FIG. 10 illustrates a graph of the pressure applied across the image transfer nip versus the deflection of the photoconductive transfer member and the carrier member.

The results listed in Table II are plotted as a function of deflection in FIGS. 8–10.

Referring now to FIG. 8, there is illustrated a graph of the compressed surface area of the image transfer nip 20 versus the deflection of the distance 80 between the photoconductive drum 16 and the carrier drum 18 for the preferred print engine 10 of the present invention.

Referring now to FIG. 9, there is illustrated a graph of the portion of total normal force $F_N$ which is applied across the image transfer nip 20 to press the photoconductive drum 16 and the carrier drum 18 together, versus the deflection of the distance 80 of the image transfer nip 20 in the direction of the normal force $F_N$.

Referring now to FIG. 10, there is illustrated a graph of the pressure applied across the image transfer nip 20 versus the deflection of the distance 80 of the photoconductive drum 16 and the carrier drum 18.

Figure 11:
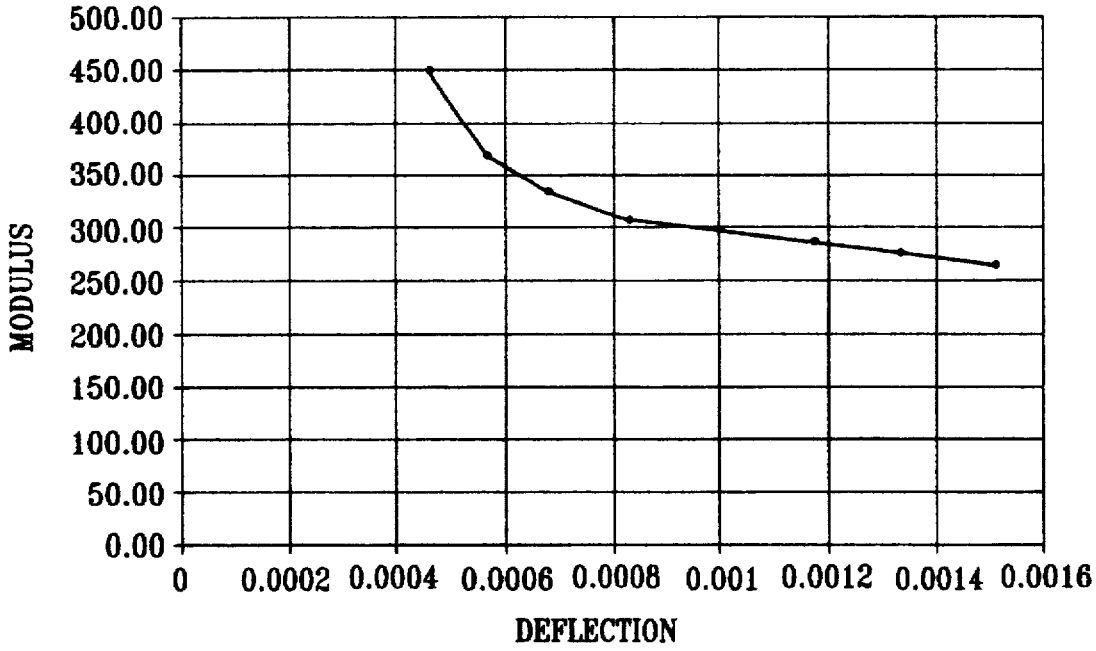
FIG. 11 illustrates a graph of the calculated composite modulus of elasticity of the materials deflected by pressing the photoconductive member and carrier member together versus the deflection of the image transfer nip.

Referring now to FIG. 11, there is illustrated a graph of the calculated, effective, composite modulus of elasticity of the materials of the image transfer nip 20 deflected by pressing the photoconductive drum 16 and the carrier drum 18 together, versus the deflection across the distance 80.

From extensive testing of various toner and developer materials, it is found that fine line breakup will most likely occur when, for the friction band and photoconductive drum 16 material used, the normal force $F_N$ exceeds 6.05 total lbs, or 1.19 pounds of normal force across the image transfer nip 20. At 1.19 lbs of normal force across the image transfer nip 20, the pressure in the image transfer nip 20 is 1.7 lbs/in$^2$. This sets the maximum pressure desired in the pressure in the image transfer nip 20 for acceptable image quality, in which fine line breakup is avoided, at 1.7 lbs/in$^2$. In some cases, this value of maximum pressure may be reduced to 1.5 lbs/in$^2$. Thus, the maximum pressure allowable in the image transfer nip 20 of any given modulus and thickness is preferably 1.5 to 1.7 lbs/in$^2$.

Given the maximum pressure constraint for the image transfer nip 20, if the values for the thickness or the composite modulus of elasticity of the materials of the image transfer nip 20 are changed, the pressure will change for the same normal force being applied. A mathematical model is constructed to simulate these responses in the following. The normal force applied is constant regardless of the modulus of elasticity or thickness of the materials of nips 20 and 21. For this model, the component of the normal force $F_N$ applied to the image transfer nip 20 varies from 0.8 to 3.1 lbs., representing the usable range in the working machine 10. The resultant area of the image transfer nip 20 is a function of the geometry of the photoconductive drum 16 and the carrier drum 18 for a given deflection across the distance 80. A plot of the area of the image transfer nip 20 as a function of the deflection across the distance 80 can be determined by correlating the plots of FIGS. 6 and 7 for the prior art print engine. A simple but well correlated function to this relationship is as follows:

$$\text{Area} = \sqrt{\text{deflection}} * 26.4 \tag{2}$$

Figure 12:
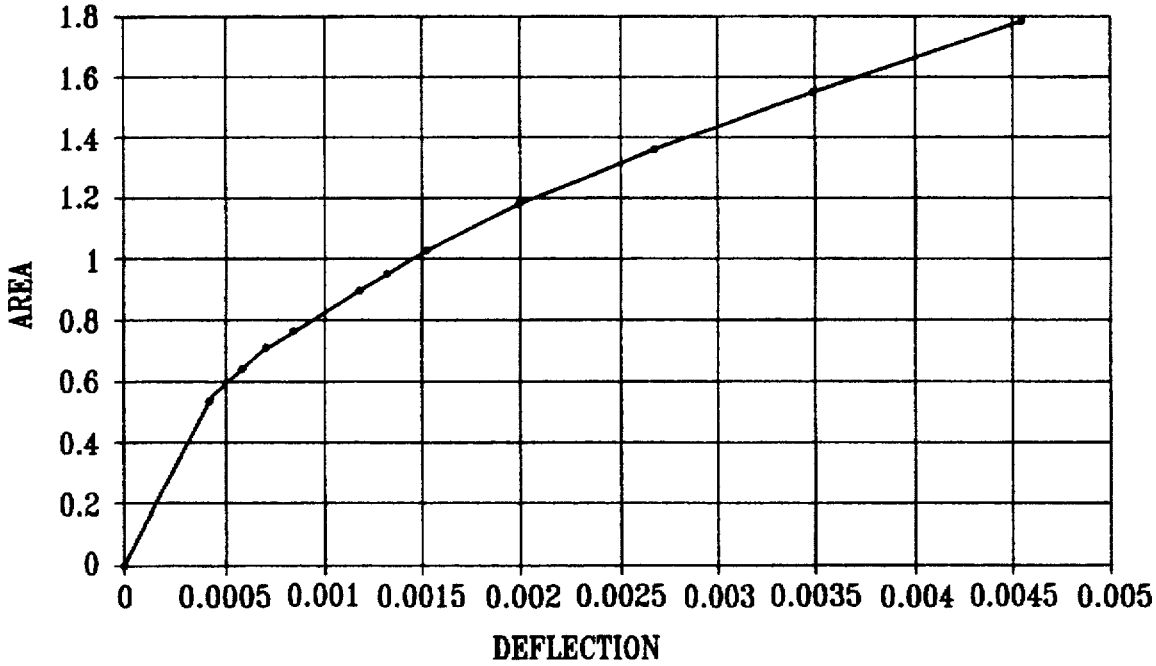
FIG. 12 illustrates a graph of the squeezed surface area of the image transfer nip verses deflection of the image transfer nip, with the plotted curve being calculated according to an equation and a portion of the measured data points of FIG. 8 being plotted according to the scale of FIG. 12, which is larger than the scale of FIG. 8.

Referring now to FIG. 12, there is illustrated a graph of the compressed surface area of the image transfer nip 20 verses the deflection of the distance 80. The plotted curve represents the compressed surface area of the image transfer nip 20 and was calculated as a function of the deflection of the distance 80 according to the above equation relating the compressed surface area to the deflection across the distance 80. The plotted points were empirically determined and are shown to provide a comparison of the values provided by the model to actual measured values.

Deflection may be found in terms of Young's modulus of elasticity by substituting the above area equation for the area term, resulting in the following equation:

$$\text{deflection}=F*lo/M*A=[F*lo/M*26.4]^{.667} \tag{3}$$

With the photoconductive drum 16 and the carrier drum 18, the surfaces forming the image transfer nip 20 are radiused and the deflection across the distance 80 varies with position across the nip 20 for any single normal force applied. The deflection across the distance 80 is actually the maximum deflection obtained. The averaged deflection would be lower.

The modulus of elasticity calculated from empirical data is found to also vary as the normal force is changed. In other words, the modulus of elasticity should stay constant for a given material, thickness and deflection. For the image transfer nip 20 this is not the case. As a result, a function to simulate the change in the effective Modulus of elasticity of the image transfer nip 20 with the normal force is developed based on inputting a single modulus value (SMV) for the resilient layer 76 of the carrier drum 18, where substantially all of the deflection occurs in print engine 10 of the preferred embodiment. The single modulus value is placed in the offset term of the equation, which creates a Y direction shift as the SMV is changed. This creates the proper functional movement as different photoconductive drum 16 materials, having different photoconductive drum 16 modulus, are evaluated. The equation is given as follows:

$$\text{Modulus}=428((\text{Force} * 10)-7)^{-.15}+(SMV-287) \tag{4}$$

Figure 13:
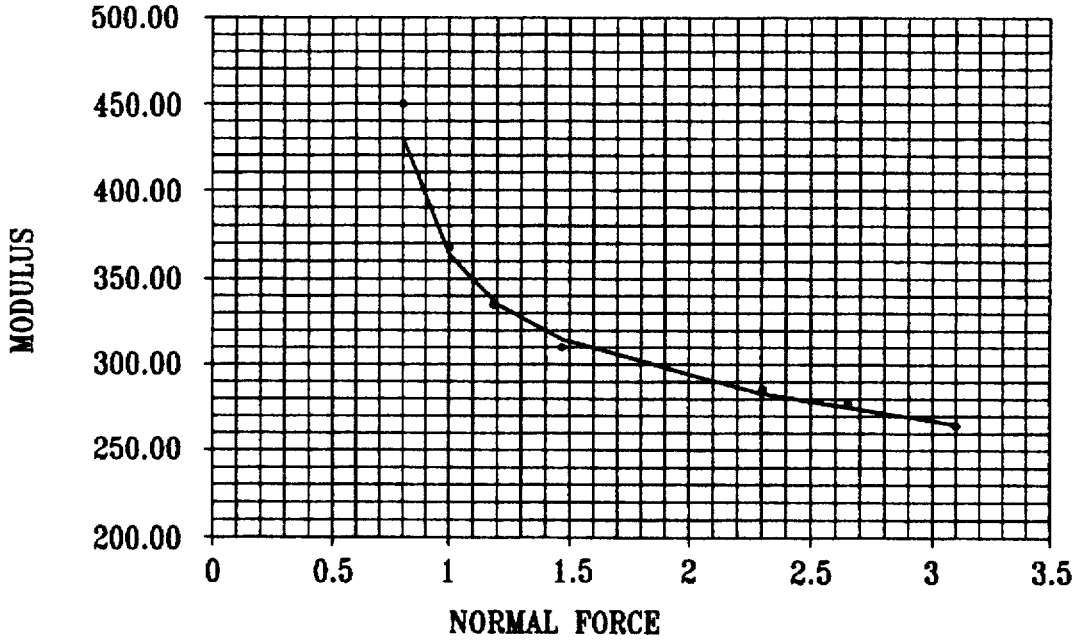
FIG. 13 illustrates a graph of the effective modulus of elasticity of the image transfer nip versus the normal force being applied at the image transfer nip, with the curve representing an effective modulus of elasticity calculated as a function of both the normal force and a single modulus of elasticity for the resilient layer of the carrier member, and the plotted points representing empirical data.

Referring now to FIG. 13, there is illustrated a graph of the effective modulus of elasticity of the image transfer nip 20 verses the portion of the normal force $F_N$ being applied across the image transfer nip 20. The curve representing the effective modulus of elasticity was calculated according to the Equation 4, as a function of the normal force being applied at the image transfer nip 20. A single value for the modulus of elasticity for the resilient layer 76 of the carrier drum 18 was used in the Equation 4. The plotted points were empirically determined.

At this point, the model is complete. The modulus of elasticity, the thickness and the normal force may be determined. The effective Modulus of the image transfer nip 20 is determined according to Equation 4. Deflection across the distance 80 is determined by Equation 3. Area of the image transfer nip 20 is determined according to Equation 2. The model results which may be determined for an equivalent modulus of elasticity for the image transfer nip 20 are calculated for various values of the thickness and the modulus of elasticity of the resilient layer 76 of the carrier member 18.

Figure 14:
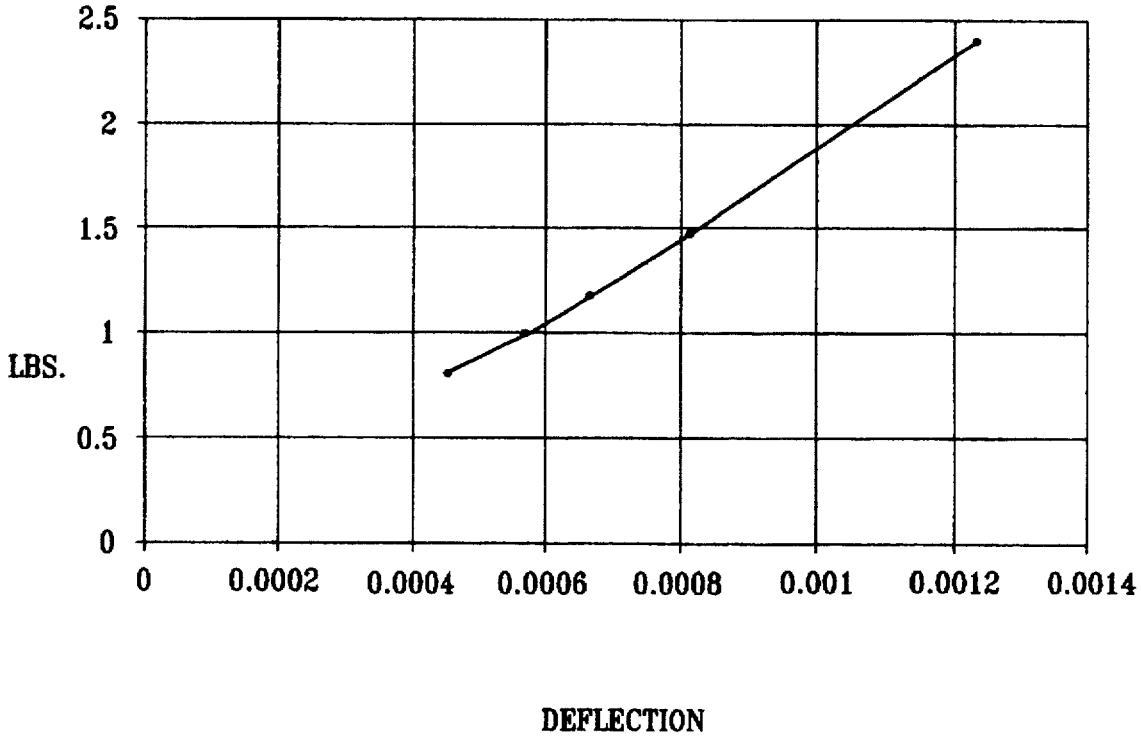
FIG. 14 illustrates a graph of the normal force applied across the image transfer nip versus the deflection of the carrier member and the photoconductive transfer member of a print engine having a carrier member which includes a resilient exterior, with the plotted curve representing the normal force calculated as a function of the deflection and the plotted points being empirically determined.

Referring now to FIG. 14, there is illustrated a graph of the portion of the normal force $F_N$ applied across the image transfer nip 20 versus the deflection across the distance 80 of the carrier drum 18 and the photoconductive drum 16, for a carrier member 18 which includes a resilient exterior layer 76 having modulus of elasticity of 297.0 and a thickness of 0.125 inches. The plotted curve representing the portion of the normal force $F_N$ being applied across the image transfer nip 20 was calculated as a function of the deflection, and the plotted points were empirically determined.

Figure 15:
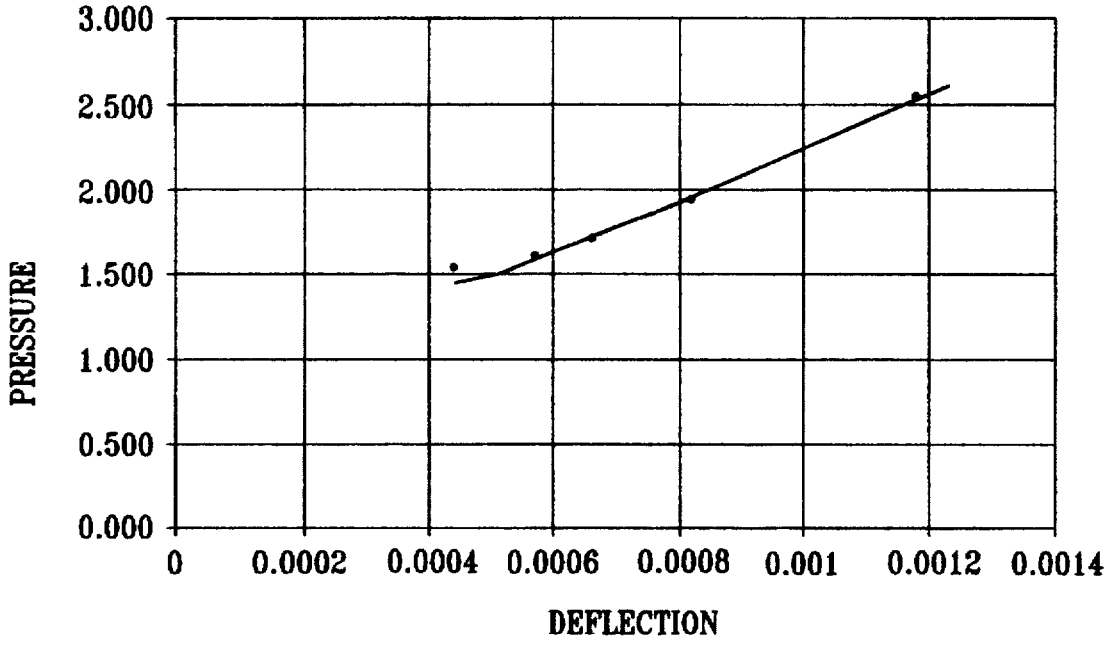
FIG. 15 illustrates a graph of the pressure applied across the image transfer nip versus the deflection across the image transfer nip of a print engine having a carrier member which includes a resilient exterior surface layer, with the plotted curve representing the pressure calculated as a function of the deflection and the plotted points being empirically determined.

Referring now to FIG. 15, there is illustrated a graph of the pressure applied across the image transfer nip 20 versus the deflection of the distance 80 of the image transfer nip 20, for a carrier drum 18 which includes a resilient exterior surface layer 76 having a modulus of elasticity of 287.0 and a thickness of 0.125 inches. The plotted curve representing the pressure across the image transfer nip 20 was calculated as a function of the deflection according to the model, and the plotted points were empirically determined.

Figure 16:
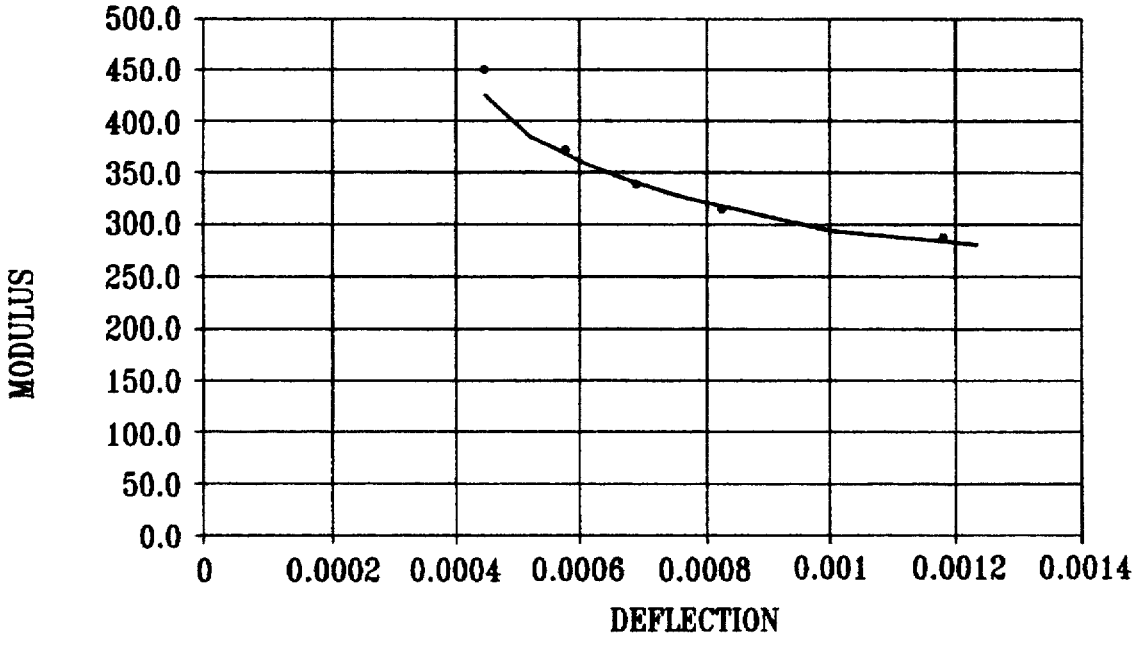
FIG. 16 illustrates a graph of the effective modulus of elasticity of the image transfer nip versus the deflection across the image transfer nip of a print engine having carrier member which includes a resilient layer, with the plotted curve representing the effective modulus of elasticity calculated as a function of the deflection and the plotted points being empirically determined.

Referring now to FIG. 16, there is illustrated a graph of the effective modulus of elasticity of the image transfer nip 20 versus the deflection of the distance 80 of the image transfer nip 20, for a carrier drum 18 having a resilient layer 76 with a modulus of elasticity of 287.0 and a thickness 0.125 inches. The plotted curve representing the effective modulus of elasticity was calculated as a function of the deflection of the distance 80 according to the model, and the plotted points were empirically determined.

Figure 17:
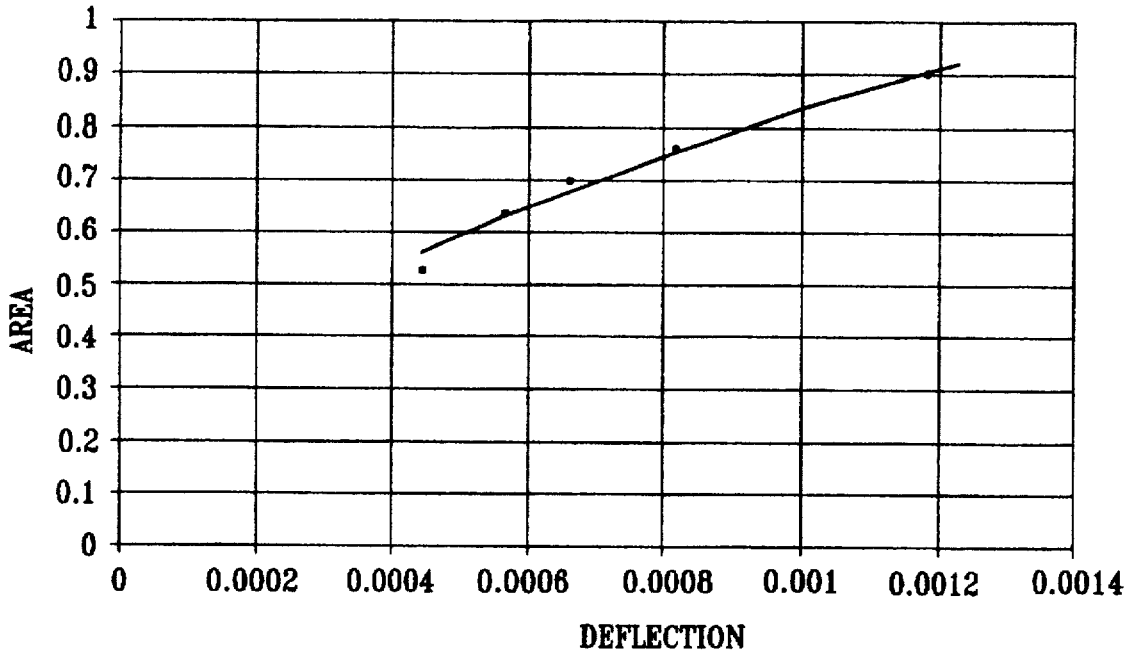
FIG. 17 illustrates a graph of the squeezed area of the image transfer nip versus the deflection across the image transfer nip of a print engine having a carrier member which includes a resilient layer, with the curve representing the squeezed area calculated as a function of the deflection and the plotted points being empirically determined.

Referring now to FIG. 17, there is illustrated a graph of the squeezed area of the image transfer nip 20 versus the deflection across the distance 80 of the image transfer nip 20, for a carrier drum 18 having a resilient layer 76 with a modulus of elasticity of 287.0 and a thickness 0.125 inches. The plotted curve representing the squeezed area of the image transfer nip 20 was calculated as a function of the deflection across the distance 80 according to the model. The plotted points were empirically determined.

Figure 18:
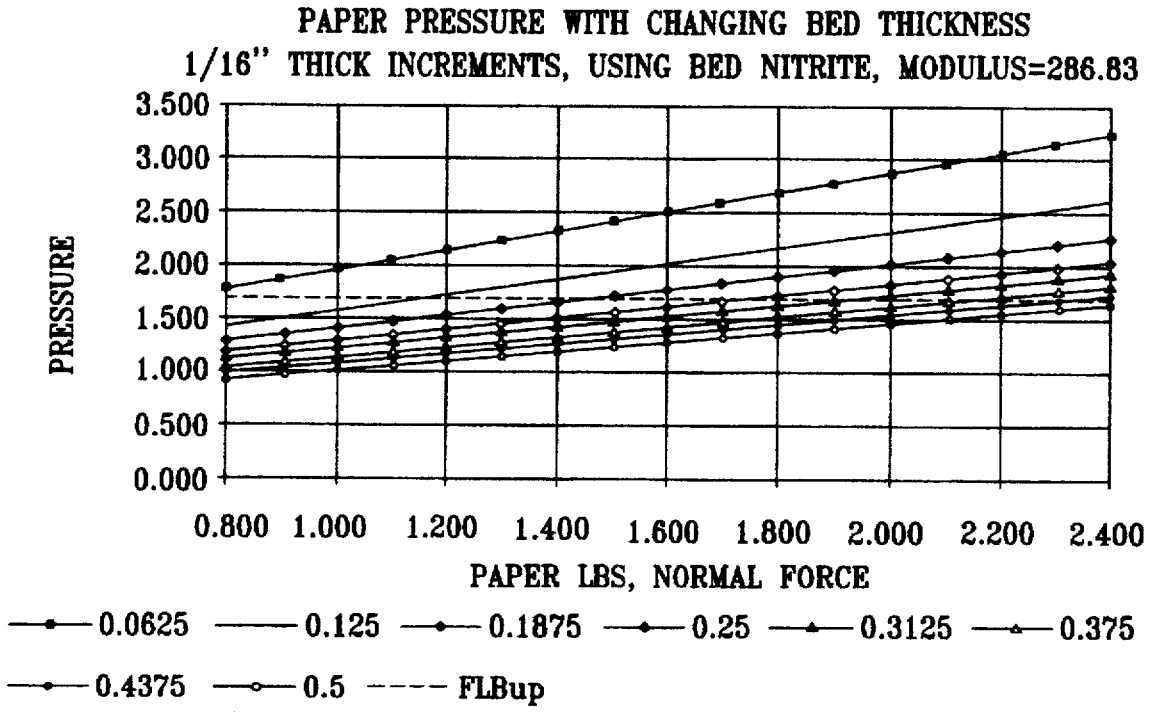
FIGS. 18 and 19 illustrate a graph of the pressure applied across the image transfer nip versus the normal force applied across the image transfer nip of print engines having carrier members, which include resilient layers of various thicknesses, and together
Figure 19:
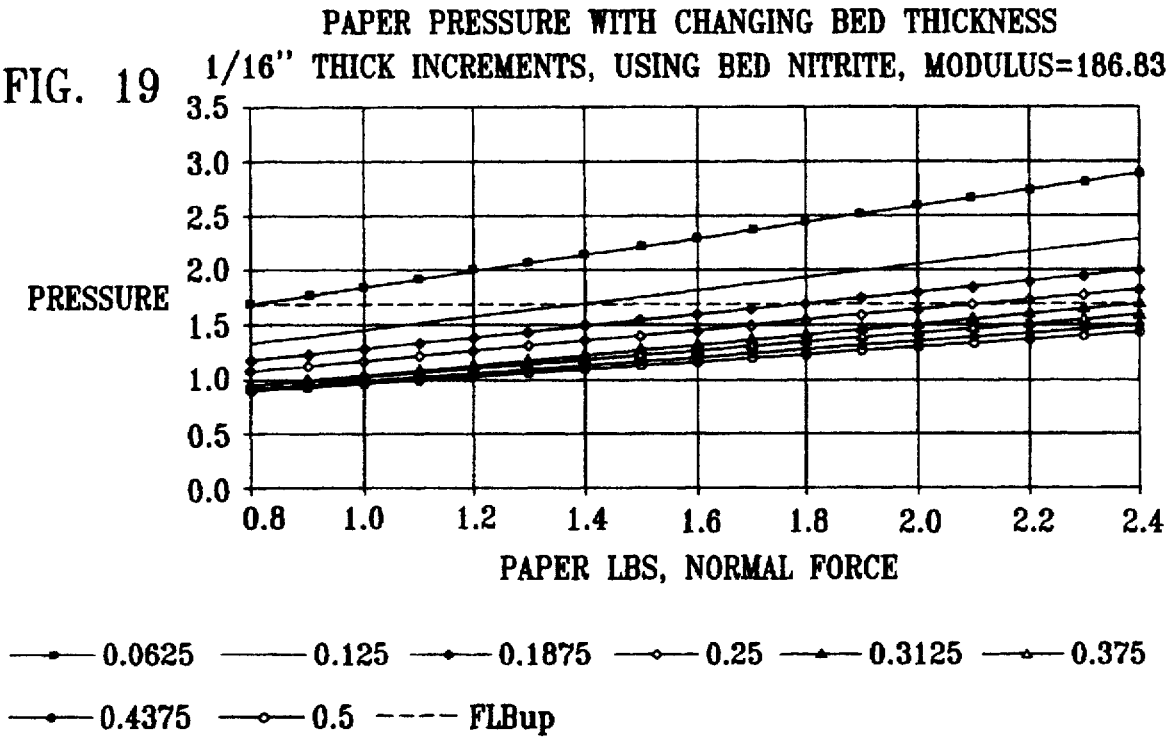

Referring now to FIGS. 18 and 19, there are illustrated examples of various combinations of various values for the modulus of elasticity and the thickness of the resilient layer 76 of the carrier member necessary to limit the maximum pressure for fine line breakup of 1.7 lb/in$^2$. Thicknesses for the resilient layer 78 ranged from 0.0625 inches to 0.5 inches. FIG. 18 illustrates the preferred modulus of elasticity of the resilient layer 76 of 287.0, and FIG. 19 illustrates an alternative Modulus of elasticity of 187.0.

Referring now to FIG. 18, there is illustrated a graph of the pressure versus the portion of the normal force $F_N$ applied across the image transfer nip 20, with an image-support member 78 disposed therein. Curve 102 represents a resilient layer 76 of the carrier member 18 having a thickness of 0.0625 inches. Curve 104 represents the resilient layer 96 having a thickness of 0.125 inches. Curve 106 represents a thickness of 0.1875 inches for the resilient layer 76. Curve 108 represents a thickness for the resilient layer 76 of 0.25 inches. Curve 110 represents a thickness for the resilient layer 76 of 0.3125 inches. Curve 112 represents a thickness for the resilient layer of 0.375 inches. Curve 114 represents a thickness for the resilient layer 76 of 0.4375 inches. Curve 116 represents a thickness for the resilient layer 76 of 0.5 inches. Curve 118 represents a plot of the maximum pressure which can be applied across the image transfer nip 20 without incurring fine line breakup.

Referring now to FIG. 19, there is illustrated a graph of the pressure applied across the image transfer nip 20 versus the portion of the normal force $F_N$ applied across the image transfer nip 20, for various thicknesses of the resilient layer 76 of the carrier drum 18 of an alternative material having a modulus of elasticity of 186.83. Curve 120 represents a resilient layer 76 having a thickness of 0.0625 inches. Curve 122 represents a resilient layer 76 having a thickness of 0.125 inches. Curve 124 represents a resilient layer 76 having a thickness of 0.1875 inches. Curve 126 represents a thickness of the resilient layer 76 of 0.25 inches. Curve 128 represents a thickness of the resilient layer 76 of 0.1325 inches. Curve 130 represents a thickness of the resilient layer 76 of 0.375 inches. Curve 132 represents a thickness of the resilient layer 76 of 0.4375 inches. Curve 134 represents a thickness of the resilient layer 76 of 0.5 inches. Curve 136 represents the maximum pressure across the image transfer nip 20 which can be applied without incurring fine line breakup, that of 1.7 pounds per square inch.

There is a minimal normal force $F_N$ required in order to facilitate drive between the carrier drum 18 and the photoconductive drum 16. The minimal acceptable normal force $F_N$ is that which does not contribute to misregistration in 4 color prints. On the working machine, this force $F_N$ was empirically found to be between approximately 2.0–3.0 lbs. This is obtained from the normal force $F_N$ difference between carrier drum 18 and photoconductive drum 16 first making contact and reaching acceptable drive conditions. In this instance, an acceptable drive is obtained before the image-support member 78 and the carrier drum 18 make contact. The limit of acceptable drive for any photoconductive drum 16 is defined according to the following parameters.

friction band thickness, friction band width, effective modulus of elasticity, and thickness of the image transfer nip 20.

Using Equation 1 and setting a minimum value for the normal force $F_N$ defines the usable range on these parameters for any change desired in the photoconductive drum 16 construct. The equation becomes $$F\min = 2-3 \text{ lbs} \leqq \frac{AM\Delta l}{lo} \tag{5}$$

where:

M=effective modulus of elasticity

A=related to friction band width

Δl =related to friction band thickness lo=friction nip thickness

At a minimum, the friction band thickness allows an acceptable friction band nip drive pressure to be reached at or before the image-support member 78 contacts the photoconductive surface of the photoconductive drum 16. In the preferred embodiment, the acceptable friction band drive nip 21 pressure is reached before the carrier drum image path 68 is pressed into and contacts the photoconductive drum image path 66. The minimum normal force $F_N$ required for a given effective modulus and thickness, and a particular friction band width and thickness, ranges from approximately 2.0 to 3.0 lbs.

Thus, the maximum pressure allowable in the image transfer nip for any given effective modulus of elasticity and thickness is preferably 1.5–1.7 lbs/in$^2$. The minimum normal force $F_N$ required for a given frictional engagement nip modulus and thickness, and friction band width and thickness ranges from approximately 2.0 to 3.0 lbs. Referring again to Table II, the image transfer nip portion of the normal force $F_N$ is approximately 1.19 lbs for a maximum image transfer nip normal pressure of 1.7 lbs/in$^2$. Thus, if a friction drive region is not present, the recommended maximum image transfer nip pressure will be exceeded if the recommended friction drive normal pressure is applied across the image transfer nip. However, in the present invention the friction bands 62 and 64 are relatively incompressible as compared to the resilient layer 76, and in the preferred embodiment the surfaces 63 and 65 of the friction bands 62 and 64, respectively, are offset to extend outward of the surface 75 of the resilient layer 76. Thus, as shown in Table I, a friction band normal force of 4.865 lbs can be provided when a normal force of 1.19 lbs is applied across the image transfer nip.

In operation, the photoconductive drum charger 12 and the image generator 14 together form a latent image of electrostatic charge on the photoconductive surface 72 of the photoconductive drum 16. The photoconductive surface 72 moves the latent image adjacent to the developer station 15. Toner, or developer, is then drawn onto the latent image by the electrostatic charge on the photoconductive surface 72 to provide a developed image. At the same time as the latent image is being formed on the exterior surface of the photoconductive member 16, the image-support member 78 is being fed by the image-support member handler 30 along the path 32 to the carrier drum 18. The exterior surface of the resilient layer 76 of the carrier drum 18 is charged with a negative potential such that the image-support member 78 will adhere to the resilient layer 76. The photoconductive transfer member 16 and the carrier drum 18 are counter rotating in the angular directions 22 and 24, respectively, so that the developed image will be passed through the image transfer nip 20 at the same time as the image-support member 78 which is adhered to the surface of the carrier drum 18. The developed image will then be transferred to the image-support member 78 carried on the exterior surface 75 of the carrier drum 18. In the preferred embodiment, image-support member 78 is a sheet of paper or a transparency sheet supported on carrier drum 18.

If a color image is being transferred, the above process will occur multiple times to sequentially place toner of the various colors on the same image-support member. Typically, the colors magenta, cyan and yellow are used for the toner. After the photoconductive surface 72 of the photoconductive drum 16 passes through the image transfer nip 20, the surface 72 will pass across cleaning station 26 and discharge station 28 so that the developer and static charge remaining on the exterior photoconductive surface 72 of the photoconductive drum 16 will be removed prior to passing beneath the image generator 12. Once the developed image is fully transferred to the image-support member 78, which is adhered to the carrier drum 18, the carrier member diverter 36 will be actuated to remove the image-support member 78 from the surface of the carrier drum 18. The image-support member 78 will then travel along the path 34 back to the paper handler 30. Operation of the print engine 10 is preferably controlled by the programmable controller 38, which preferably includes a central processing unit and memory storage.

Transferring a color image from the photoconductive drum 16 to the image-supporting member 78 requires the proper alignment between the carrier drum 18 and the photoconductive drum 16 to insure that the developed image properly registers with the image-support member 78 as they are being passed together through the image transfer nip 20. This requires that the support surface 75 of the carrier drum 18 travel in the same direction and at substantially the same velocity through the image transfer nip 20 as that which the photoconductive surface 72 of photoconductive transfer member 16 is traveling. It should be noted that in the preferred print engine 10, the surface of the image-support member 78, which directly engages photoconductive surface 72, preferably travels at precisely the same speed as photoconductive surface 72 at image transfer nip 20.

The drive motor 48 is mechanically coupled directly to the shaft 40 of the photoconductive transfer member 16. The carrier drum 18 is powered by a frictional coupling created by a normal force $F_N$ being applied to the shaft 50 to push the carrier drum 18 into the exterior surface 72 of the photoconductive transfer member 16. The normal force $F_N$ is provided by the mounting assemblies 56, which are adjustable by the control means 60 to vary the forces $F_1$ and $F_2$, which are applied to opposite sides of shaft 50 for pressing the carrier drum 18 into the photoconductive transfer member 16. The normal force $F_N$ is the component of the vector sum of forces $F_1$ and $F_2$, and is perpendicular to the linear direction in which the photoconductive transfer member, drum 16 and the carrier drum 18 are moving through the image transfer nip 20.

The control members 60 are adjusted so that the springs 58 together press against opposite sides of the shaft 50 with a minimum combined normal force $F_N$ of approximately 2.0 to 3.0 pounds to assure that the carrier drum 18 will move the through image transfer nip 20 at substantially the same linear speed as the photoconductive surface 72 of the photoconductive transfer member 16. The friction bands 62 and 64 will be pressed into frictional engagement with the exterior surface of the photoconductive surface 78 of the photoconductive transfer member 16, each of the bands 62 and 64 being pressed into surface 78 with one-half of the total normal force $F_N$. As discussed above, the modulus of elasticity, the thickness and the width of the photoconductive surface 72, resilient layer 76 and the friction bands 62 and 64 will be preferably selected so that the photoconductive surface 72 and the resilient surface 76 will not squeeze the image-support member 78 therebetween with a pressure of substantially more than 1.7 pounds per square inch.

Figure 20:
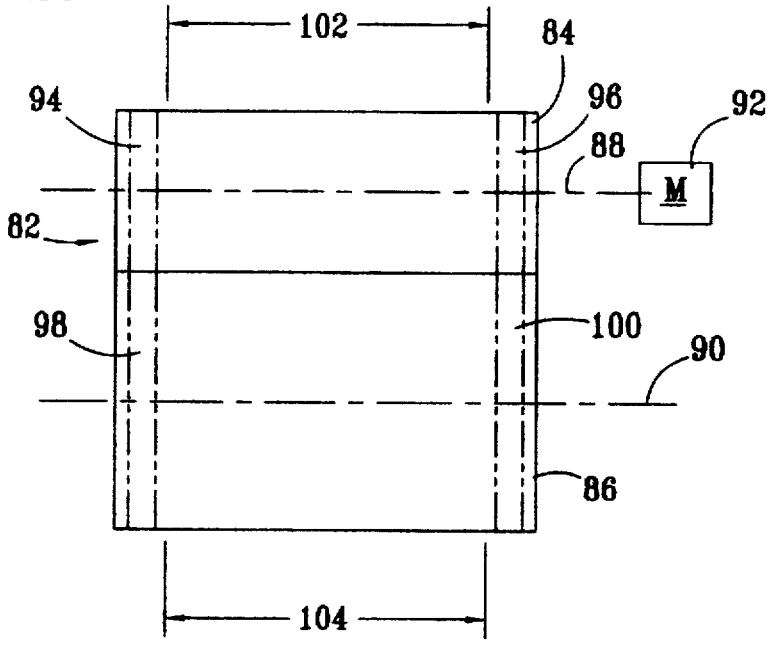
FIG. 20 illustrates a side view of a photoconductive transfer member and a carrier member of a print engine of a first alternate embodiment of the present invention.

Referring now to FIG. 20, there is illustrated a side view of a schematic diagram depicting an alternative print engine 82 of the present invention. The alternative print engine 82 includes a photoconductive drum 84 and a carrier drum 86 which are mounted for rotating about longitudinal axes 88 and 90, respectively. The photoconductive drum 84 is powered to rotate about the longitudinal axis 88 by a drive motor 92, which is mechanically directly coupled to the photoconductive drum 84. The photoconductive drum 84 includes two frictional drive regions which define two clean, frictional drive surfaces 94 and 96, which are preferably flush with and spaced apart on opposite sides of the image transfer path 102. The carrier drum 86 includes two frictional drive regions which define two clean, frictional drive surfaces 98 and 100, which are preferably flush with and spaced apart on opposite sides of an image-support member path 104. The clean drive surfaces 94 and 96 are provided by the same peripherally extending exterior surface at which the exterior surface of the photoconductive drum 84 is provided along the image path 82. Similarly, the clean, drive, frictional engagement surfaces 98 and 100 are provided by the same peripherally extending surfaces of the carrier drum 86 with its resilient surface, at which the exterior surface of the drum 86 is provided along the image-support member path 104.

Drive surfaces 94, 96, 98 and 100 define frictional engagement bands which are integrally formed into the exterior surfaces of drums 84 and 86, respectively. The two friction drive regions of carrier drum 86 which define drive surfaces 98 and 100 have a larger modulus of elasticity than the modulus of elasticity for the peripheral portion of carrier drum 86 between drive surfaces 98 and 100 which defines the image support member path 104, such that a sufficient normal force may be applied across the friction drive regions without the normal pressure within the image transfer nip exceeding the recommended maximum pressure of 1.7 lbs/in$^2$. Preferably, the width of the image transfer nip defined by the image transfer path 102 and the image-support path 104 will be substantially wider than the combined widths of the two friction drive regions defining drive surfaces 98 and 100. It should also be noted that in other embodiments, the drive regions of photoconductive drum 84 may have a modulus of elasticity which significantly larger than the modulus of elasticity of the photoconductive region therebetween such that a sufficient normal force $F_N$ may be applied without exceeding the recommended maximum nip pressure of 1.7 lbs/in$^2$. Materials having a higher modulus of elasticity than others will typically be harder than the materials having a lower modulus of elasticity.

In operation, the carrier member 86 and the photoconductive drum 84 are pressed together with a sufficient normal force $F_N$ so that a frictional engagement will occur between the clean, frictional drive surfaces 94 and 96 of photoconductive drum 84 and the clean, frictional drive surfaces 98 and 100 of carrier drum 86, such that rotation of the photoconductive drum 84 will cause rotation of the carrier drum 90. The sufficient normal force $F_N$ of two to three pounds must be provided as discussed above such that the exterior surface of the carrier drum will rotate at the same speed as the exterior surface of photoconductive drum 84 as it passes through the image transfer nip, while excessive pressure, above 1.7 lbs/in$^2$, is not applied so that fine-line breakup will not occur.

Figure 21:
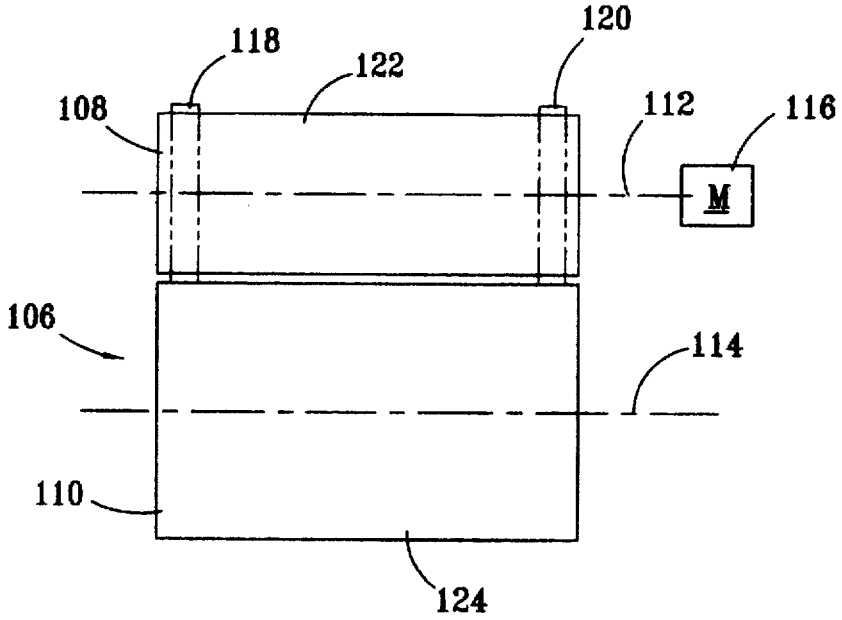
FIG. 21 illustrates a side view of photoconductive transfer member and a carrier member of a second alternate embodiment of the present invention.

Referring now to FIG. 21, there is illustrated a side view of a schematic diagram depicting a print engine 106 of a second alternative embodiment of the present invention. The print engine 106 includes an image transfer drum 108 having a photoconductive exterior surface and a carrier drum 110 having a circumferentially extending resilient surface which are rotatably mounted for rotating about longitudinal axes 112 and 114, respectively. The photoconductive transfer member 108 is powered to concentrically rotate around the longitudinal axis 112 by a drive motor 116, which is directly mechanically coupled to the photoconductive drum 108. Two raised frictional engagement bands 118 and 120 are provided by a friction tape which extends circumferentially around the photoconductive drum 108 on opposite sides of an image transfer surface 122, which is disposed within a central region of the circumferentially extending exterior surface of the photoconductive drum 108. Friction bands 118 and 120 are not flush with the photoconductive surface of drum 108. The friction bands 118 and 120 of the photoconductive drum 108 are also spaced apart and frictionally engage the carrier drum 110 on opposite sides of the image-support member path 124. The photoconductive drum 108 and the carrier drum 110 are pressed toward one another with the friction bands 118 and 120 therebetween such that rotation of the image transfer drum 108 will cause rotation of the carrier drum 110 at the same speed through an image transfer nip defined by the exterior surfaces of the photoconductive drum 108 and the carrier drum 110.

In other embodiments of the present invention, the frictional engagement bands may be disposed on both the photoconductive member and the carrier member to provide a frictional engagement for driving one of these members in response to relative movement of the other member. Additionally, frictional engagement bands may be provided by regions of clean drive surfaces, without friction tape, which are pressed into one another to provide a frictional engagement for driving one of the carrier member and the photoconductive transfer member in response to rotation of the other of the members. These regions of clean surfaces may be raised from the surfaces of the image path and image-support member path, as shown in FIG. 21, or they may be flush with the surfaces of the image path and image-support member path, as shown in FIG. 20. In still other embodiments of the present invention, such as where belts are used to provide one or both of a carrier surface and a photoconductive surface, and the belts extend over rollers or guide plate surfaces at image transfer nips, frictional engagement bands may be provided on such surfaces to provide the frictional engagement therebetween for driving one surface in response to movement of the other surface.

In summary, a print engine is provided having a photoconductive image transfer member and a carrier member which are pressed together into a frictional engagement so that the carrier member will be driven by rotation of the photoconductive member. Banding caused by gear lash is avoided by such frictional engagement-type of drive. Preferably, two cylindrically disposed frictional engagement bands extend around the circumferential periphery of the carrier member, spaced apart on opposite sides of an image transfer path and an image-support member path. Sufficient force is provided so that as the image-support member is rotated multiple times around the carrier member, it will register with various ones of the developed images being transferred from the photoconductive transfer member to the image-support member so that various color components of the image are properly aligned. Additionally, the materials from which the frictional engagement bands, the photoconductive member and carrier member are formed are preferably selected, as well as the dimensions thereof, so that excessive force will not be applied to the image-support member as it is passing through the image transfer nip so that fine-line breakup is avoided.

Although the preferred and several alternative embodiments have been described in detail, it should be understood that various changes, substitutions and alterations can be made therein without departing from the spirit and scope of the invention as defined by the appended claims.

What is claimed is:

1. An electrophotographic print engine for electrophotographically printing images onto an image carrier, said print engine having a transfer device for transferring a developed image across a transfer nip, comprising:

a photoconductive member for carrying a developed image;

an image carrier for receiving from said photoconductive member said developed image in a defined image path on said image carrier, an arcuate one of said photoconductive member and said image carrier having an arcuate surface associated therewith that is disposed adjacent the other of said photoconductive member and said image carrier to form a transfer nip therebetween;

a drive region disposed outside of said image path on both said photoconductive member and said image carrier;

a drive mechanism for driving a first one of said photoconductive member or said image carrier; and a pressure member for urging said photoconductive member and said image carrier together at said transfer nip, such that a predetermined first force is provided at said transfer nip, with first and second surfaces of respective ones of said photoconductive member and said image carrier which are disposed in said drive region configured to provide a second force therebetween, which is greater than said first force and provides a frictional engagement between said first and second surfaces to drive a second one of said photoconductive member and said image carrier which is not driven by said drive mechanism.

2. The print engine of claim 1, wherein said photoconductive member is driven by said drive mechanism.

3. The print engine of claim 1, wherein one of said photoconductive member and said image carrier includes first and second portions defining an outer periphery thereof, wherein said first portion defines one of said first and second surfaces of said photoconductive member and said image carrier in said drive region, said second portion defines, in part, said transfer nip, and said first portion of said drive region has a greater modulas of elasticity than said second portion of said transfer nip.

4. The print engine of claim 1, wherein said photoconductive member is a cylindrical member.

5. The print engine of claim 4, wherein said image carrier is a cylindrical member.

6. The print engine of claim 5, wherein said image carrier comprises:

a cylindrical support surface;

a resilient layer disposed on said cylindrical support surface; and a support member disposed on said resilient layer for receiving said developed image from said photoconductive member in said transfer nip.

7. The print engine of claim 6, wherein said resilient layer of said image carrier comprises a raised portion disposed within said drive region for defining said second surface and engaging said first surface of said photoconductive member.

8. The print engine of claim 7, wherein said second surface of said raised portion of said resilient layer has a first portion hardness of a durometer that is harder than a second portion hardness of said resilient layer within said image path.

9. A print engine for electrophotographically transferring an image from an image source to an image-support member, comprising:

a photoconductive surface for transporting an image formed thereon and being moveable to move said image along an image path;

a carrier member having an electrically charged support surface for passing through an image transfer nip extending along said image path and between said photoconductive surface and said carrier member, wherein said image is transferred from said photoconductive surface to said carrier member at said image transfer nip;

a first one of said carrier member and said photoconductive surface including at least one friction band for pressing into a second one of said carrier member and said photoconductive surface to provide a frictional engagement therebetween;

a drive motor mechanically coupled to one of said carrier member and said photoconductive surface for powering movement of said one of said carrier member and said photoconductive surface; and a mounting assembly for moveably supporting said photoconductive surface and said carrier member with said friction band in said frictional engagement therebetween for moving the other of said photoconductive surface and said carrier member in response to said one of said photoconductive surface and said carrier member moving.

10. The print engine according to claim 9, wherein said photoconductive surface and said electrically charged support surface each have a clean drive region, disposed outside of said image path and an image-support member path, one of said clean drive regions defining said friction band for engaging the other of said clean drive regions.

11. The print engine according to claim 9, wherein said friction band comprises a friction tape mounted to said first one of said photoconductive surface and said carrier member, and extending therefrom to engage said second one of said photoconductive surface and said carrier member outside of said image path.

12. The print engine according to claim 9, wherein a maximum normal pressure between said carrier member and said photoconductive surface is not substantially more than 1.7 pounds per square inch.

13. The print engine according to claim 9, wherein said frictional engagement between said photoconductive surface and said carrier member arises from a normal force which is not substantially less than two pounds.

14. The print engine according to claim 9, wherein said photoconductive surface comprises a photoconductive layer disposed around a circumferentially extending periphery of a cylindrical drum.

15. The print engine according to claim 9, wherein said carrier member comprises a cylindrical drum having a cylindrical core and a resilient layer disposed exteriorly around a circumferentially extending periphery of said cylindrical core.

16. A print engine for electrophotographically transferring an image from an image source to an image-support member, said print engine comprising:

a photoconductive member having a peripherally defined photoconductive surface and a photoconductive member friction surface, said photoconductive surface being operable for forming an image thereon and moving said image along an image path, and said photoconductive member friction surface extending parallel to and outside of said image path;

a carrier member having a peripherally defined electrically charged support surface and a carrier member friction surface, said electrically charged support surface being disposed for passing through an image transfer nip extending along said image path and between said photoconductive member and said carrier member for transferring said image from said photoconductive surface to said carrier member at said image transfer nip, and said carrier member friction surface extending parallel to and outside of said image path;

a drive motor mechanically coupled to one of said photoconductive member and said carrier member for powering movement of said one of said photoconductive member and said carrier member; and a mounting assembly for moveably supporting said photoconductive member and said carrier member, and pressing said photoconductive member friction surface and said carrier member friction surface together into a frictional engagement for moving one of said photoconductive surface and said electrically charged support surface at substantially a same speed and direction as the other of said photoconductive and electrically charged support surfaces in response to said other of said photoconductive and electrically charged support surfaces moving.

17. The print engine according to claim 16, wherein said carrier member friction surface is defined by a strip of tape which is mounted to said electrically charged support surface and continuously extends completely around one end of said electrically charged support surface.

18. The print engine according to claim 17, wherein said photoconductive member friction surface is defined by a continuous frictional engagement region of an outer portion of said photoconductive surface.

19. The print engine according to claim 16, wherein said photoconductive member friction surface is defined by a strip of tape which is mounted to and continuously extends completely around an outward portion of said photoconductive surface.

20. The print engine according to claim 16, wherein the maximum normal pressure between said carrier member and said photoconductive surface at said image path is not substantially more than 1.7 pounds per square inch.

21. The print engine according to claim 20, wherein said frictional engagement between said photoconductive member friction surface and said carrier member friction surface arises from a normal force which is not substantially less than two pounds.

22. The print engine according to claim 16, wherein a minimum normal pressure between said photoconductive member friction surface and said carrier member friction surface is greater than a maximum normal pressure between said photoconductive surface and said electrically charged support surface at said image transfer nip.

23. A print engine for electrophotographically transferring an image from an image source to an image-support member, said print engine comprising:

a photoconductive drum having a photoconductive drum periphery defined by a cylindrical photoconductive surface and a cylindrical photoconductive drum friction surface, said photoconductive surface being disposed for storing a latent image of electric charge in response to exposure to a light corona and being moveable to move said latent image along an image path, and said photoconductive drum friction surface extending parallel to and outside of said image path;

a photoconductive drum charger for providing a substantially uniform blanket of electric charge upon said photoconductive surface;

an image transfer device for exposing said photoconductive surface of said photoconductive drum having said blanket of electric charge to light of various intensities, which correspond to various portions of the image of the image source, to provide said latent image;

a developer station disposed along said image path for supplying developer to said latent image disposed on said photoconductive surface to define a developed image;

a carrier drum having a carrier drum periphery defined by a cylindrical electrically charged support surface and a cylindrical carrier drum friction surface, said electrically charged support surface being disposed for passing through an image transfer nip extending along said image path and between said photoconductive drum and said carrier drum for transferring said developed image from said photoconductive surface of said photoconductive drum to said carrier drum at said image transfer nip, and said carrier drum friction surface extends circumferentially around said carrier drum, parallel to and outside of said image path;

a mounting assembly for rotatably supporting said photoconductive drum and said carrier drum, and pressing together said photoconductive drum friction surface and said carrier drum friction surface into a frictional engagement for moving one of said photoconductive surface and said electrically charged support surface at substantially a same speed and direction as the other of said surfaces in response to said other of said surfaces moving;

a drive assembly having a drive motor and a direct mechanical coupling extending between said drive motor and one of said photoconductive drum and said carrier drum, wherein said drive motor directly powers rotation of said one of said drums which powers movement of the other of said drums by engagement of said photoconductive drum friction surface and said carrier drum friction surface; and wherein said photoconductive drum and said carrier drum peripheries are defined such that a minimum normal pressure of said frictional engagement between said photoconductive drum friction surface and said carrier drum friction surface is greater than a maximum normal pressure between said photoconductive surface and said electrically charged support surface at said image transfer nip.

24. The print engine according to claim 23, wherein said carrier drum friction surface is defined by a friction band which is mounted to and continuously extends completely around said electrically charged support surface of said carrier drum periphery, with said carrier drum friction surface being offset to extend within a different plane than said electrically charged support surface.

25. The print engine according to claim 24, wherein said photoconductive drum friction surface is defined by an outer portion of said photoconductive surface.

26. The print engine according to claim 23, wherein said frictional engagement between said photoconductive drum friction surface and said carrier drum friction surface arises from a normal force which is not substantially less than two pounds.

27. The print engine according to claim 23, wherein a maximum normal pressure between said carrier drum and said photoconductive surface of said photoconductive drum is not substantially more than 1.7 pounds per square inch.

28. A method of electrophotographically transferring an image from an image source to an image-support member, the method comprising the steps of:

providing a print engine having a photoconductive member which includes a photoconductive surface and a carrier member which includes an electrically charged support surface, wherein the photoconductive surface and the electrically charged support surface are moveable together through an image transfer nip;

moveably mounting the photoconductive member and the carrier member in a closely spaced relation, wherein a photoconductive member peripheral surface is disposed in a frictional engagement with a carrier member peripheral surface, aside of the image transfer nip;

moving both the photoconductive member and the carrier member such that each is moving at substantially a same speed and direction through the image transfer nip, wherein one of the photoconductive member and the carrier member is powered to move by a direct mechanical coupling extending between said one of the members and a drive motor, and the other of the members is powered to move by the frictional engagement between the photoconductive member peripheral surface and the carrier member peripheral surface transferring motive forces therebetween;

forming an image on the photoconductive surface;

disposing an image-support member on the electrically charged support surface of the carrier member; and simultaneously passing through the image transfer nip the image-support member and the image, wherein the image-support member is disposed on the electrically charged support surface, the image is initially disposed on the photoconductive surface and then the image is transferred from the photoconductive surface to the image-support member at the image transfer nip.

29. The method according to claim 28, wherein the step of providing the print engine further comprises selecting the photoconductive member, the photoconductive surface thereof and the carrier member such that the step of moveably mounting the photoconductive member and carrier member to provide the frictional engagement will not apply a normal pressure of substantially more than 1.7 pounds per square inch to the image-support member at the image transfer nip.

30. The method according to claim 29, wherein the step of moveably mounting the photoconductive member and the carrier member to provide the frictional engagement applies a normal force of not substantially less than 2 pounds.

31. The method according to claim 28, wherein a minimum normal pressure between the photoconductive member peripheral surface and the carrier member peripheral surface which provides the friction engagement therebetween is greater than a maximum normal pressure therebetween in the image transfer nip.

* * * * *

UNITED STATES PATENT AND TRADEMARK OFFICE

CERTIFICATE OF CORRECTION

PATENT NO. : 5,799,232
DATED : August 25, 1998
INVENTOR(S) : Tompkins et al.

It is certified that error appears in the above-identified patent and that said Letters Patent is hereby corrected as shown below:

Column 5,
Line 61, replace "thereof." with -- thereof. --

Column 8,
Line 16, replace "fraction" with -- friction --

Column 10,
Line 28, replace "3.000" with -- 3.100 --

Signed and Sealed this

Twenty-third Day of April, 2002

*Attest:*

*Attesting Officer*

JAMES E. ROGAN
*Director of the United States Patent and Trademark Office*